US009592980B2

(12) United States Patent
Hongo

(10) Patent No.: US 9,592,980 B2
(45) Date of Patent: Mar. 14, 2017

(54) PAPER CONVEYING APPARATUS, JAM DETECTION METHOD, AND COMPUTER-READABLE, NON-TRANSITORY MEDIUM

(71) Applicant: PFU LIMITED, Kahoku-shi, Ishikawa (JP)

(72) Inventor: Masanobu Hongo, Kahoku (JP)

(73) Assignee: PFU LIMITED, Kahoku-shi (JP)

( * ) Notice: Subject to any disclaimer, the term of this patent is extended or adjusted under 35 U.S.C. 154(b) by 0 days.

(21) Appl. No.: 15/029,541

(22) PCT Filed: Dec. 13, 2013

(86) PCT No.: PCT/JP2013/083507
§ 371 (c)(1),
(2) Date: Apr. 14, 2016

(87) PCT Pub. No.: WO2015/087453
PCT Pub. Date: Jun. 18, 2015

(65) Prior Publication Data

US 2016/0251183 A1 Sep. 1, 2016

(51) Int. Cl.
*B65H 7/02* (2006.01)
*B65H 7/06* (2006.01)
(Continued)

(52) U.S. Cl.
CPC ..... *B65H 7/06* (2013.01); *B65H 5/062* (2013.01); *B65H 7/14* (2013.01); *B65H 29/125* (2013.01);
(Continued)

(58) Field of Classification Search
CPC ..... B65H 63/0325; B65H 2553/30; B65H 2515/82
See application file for complete search history.

(56) References Cited

U.S. PATENT DOCUMENTS 8,827,267 B2 * 9/2014 Hongo ..... B65H 3/063 271/258.01
2012/0019841 A1 1/2012 Schaertel et al.
(Continued)

FOREIGN PATENT DOCUMENTS

JP 57-169767 A 10/1982
JP 2001-302021 A 10/2001
(Continued)

OTHER PUBLICATIONS

International Search Report for International Application No. PCT/JP2013/083507, mailed Mar. 18, 2014, 4pp.
(Continued)

*Primary Examiner* — Howard Sanders
(74) *Attorney, Agent, or Firm* — Lewis Roca Rothgerber Christie LLP

(57) ABSTRACT

There is provided the paper conveying apparatus, jam determining method, and computer program, which can suppress the mistaken determining of the occurrence of a jam by sound due to a sound generated by a moving member driven in relation to conveyance of a paper. The paper conveying apparatus according to an embodiment includes a moving member driven in relation to conveyance of a paper, a drive module for driving the moving member, a sound signal generator for generating a sound signal corresponding to a sound generated by a paper during conveyance of the paper, a sound jam detector for determining whether a jam has occurred based on the sound signal, and a control module for stopping conveyance of a paper when the sound jam detector determines that a jam has occurred. The control module controls so that the sound jam detector determines whether a jam has occurred by a determining method different from a determining method used while the drive module is not driving the moving member, or the sound jam detector does
(Continued)

not determine whether a jam has occurred, while the drive module is driving the moving member.

11 Claims, 19 Drawing Sheets

(51) Int. Cl.

| | |
|---|---|
| ***B65H 5/06*** | (2006.01) |
| ***B65H 7/14*** | (2006.01) |
| *B65H 63/032* | (2006.01) |
| *B65H 29/12* | (2006.01) |

(52) U.S. Cl.
CPC .. *B65H 63/0325* (2013.01); *B65H 2404/6111* (2013.01); *B65H 2511/528* (2013.01); *B65H 2515/82* (2013.01); *B65H 2553/30* (2013.01); *B65H 2801/06* (2013.01); *B65H 2801/39* (2013.01)

(56) References Cited

U.S. PATENT DOCUMENTS

| | | | | |
|---|---|---|---|---|
| 2013/0093136 | A1 | 4/2013 | Sakharshete et al. | |
| 2014/0054844 | A1 | 2/2014 | Morikawa et al. | |
| 2014/0077447 | A1 | 3/2014 | Hongo et al. | |
| 2016/0109843 | A1* | 4/2016 | Link ..... | G03G 15/70 399/21 |

FOREIGN PATENT DOCUMENTS

| | | | |
|---|---|---|---|
| JP | 2011-31999 | A | 2/2011 |
| JP | 2012-131579 | A | 7/2012 |
| JP | 5340463 | B1 | 8/2013 |
| JP | 5409868 | B1 | 2/2014 |

OTHER PUBLICATIONS

Written Opinion for corresponding International Application No. PCT/JP2013/083507 mailed Mar. 18, 2014, including English translation 9pp.

* cited by examiner

PAPER CONVEYING APPARATUS, JAM DETECTION METHOD, AND COMPUTER-READABLE, NON-TRANSITORY MEDIUM

CROSS-REFERENCE TO RELATED APPLICATION(S)

This application is a National Phase Patent Application and claims the priority of International Application Number PCT/JP2013/083507, filed on Dec. 13, 2013, the entire contents of which are incorporated herein.

TECHNICAL FIELD

Embodiments discussed in the present specification relate to paper conveying apparatus, jam detection method and computer program, particular to paper conveying apparatus, jam detection method and computer program determining whether a jam has occurred based on a sound generated by a paper during conveyance.

BACKGROUND

In a paper conveying apparatus of an image reading apparatus, image copying apparatus, etc., sometimes a jam occurs when the paper moves along the conveyance path. In general, a paper conveying apparatus is provided with the function of determining whether a jam has occurred by a paper being conveyed to a predetermined position inside the conveyance path within a predetermined time from the start of conveyance of the paper and of stopping the operation of the apparatus when a jam has occurred.

On the other hand, if a jam occurs, a large sound is generated in the conveyance path, so the paper conveying apparatus can determine whether a jam has occurred based on the sound which is generated on the conveyance path and thereby detect the occurrence of a jam without waiting for the elapse of the predetermined time.

A document conveying apparatus comparing sound energy received from at least two microphones and determining whether it is environmental noise, whether two sheets were conveyed, and whether a single sheet was damaged. This document conveying apparatus stops to prevent a document from being damaged when two sheets have been conveyed or a single sheet has been damaged (see PLT 1).

CITATION LIST

Patent Literature

PLT 1: U.S. Patent Publication No. 2013/0093136A

SUMMARY

Technical Problem

When a paper conveying apparatus conveys a paper, a large sound is generated by a specific moving member being driven. Sometimes it is mistakenly determined that a jam has occurred.

An object of the paper conveying apparatus, jam determining method, and computer program is to suppress the mistaken determining of the occurrence of a jam by sound due to a sound generated by a moving member driven in relation to conveyance of a paper.

Solution Problem

The paper conveying apparatus according to an embodiment includes a moving member driven in relation to conveyance of a paper, a drive module for driving the moving member, a sound signal generator for generating a sound signal corresponding to a sound generated by a paper during conveyance of the paper, a sound jam detector for determining whether a jam has occurred based on the sound signal, and a control module for stopping conveyance of a paper when the sound jam detector determines that a jam has occurred. The control module controls so that the sound jam detector determines whether a jam has occurred by a determining method different from a determining method used while the drive module is not driving the moving member, or the sound jam detector does not determine whether a jam has occurred, while the drive module is driving the moving member.

The jam detection method according to an embodiment includes driving a moving member driven in relation to conveyance of a paper, acquiring a sound signal corresponding to a sound which a paper generates during conveyance, determining, by a computer, whether a jam has occurred based on the sound signal, and stopping conveyance of a paper when determining that a jam has occurred. The computer controls so that the sound jam detector determines whether a jam has occurred by a determining method different from a determining method used while the drive module is not driving the moving member, or the sound jam detector does not determine whether a jam has occurred, while the drive module is driving the moving member, in the determining step.

The computer program for a computer according to an embodiment causes the computer to execute a process, the process includes driving a moving member driven in relation to conveyance of a paper, acquiring a sound signal corresponding to a sound which a paper generates during conveyance, determining whether a jam has occurred based on the sound signal, and stopping conveyance of a paper when determining that a jam has occurred. The computer controls so that the sound jam detector determines whether a jam has occurred by a determining method different from a determining method used while the drive module is not driving the moving member, or the sound jam detector does not determine whether a jam has occurred, while the drive module is driving the moving member, in the determining step.

Advantageous Effects of Invention

According to the present embodiment, the paper conveying apparatus controls so that the paper conveying apparatus determines whether a jam has occurred by a determining method different from determining method used while not driving a moving member, or the paper conveying apparatus does not determine whether a jam has occurred, while the drive module is driving the moving member. Therefore, it becomes possible to suppress mistaken determining of occurrence of a jam by sound due to a sound generated by a moving member driven in relation to conveyance of a paper.

The object and advantages of the invention will be realized and attained by means of the elements and combinations particularly pointed out in the claims. It is to be understood that both the foregoing general description and the following detailed description are exemplary and explanatory, and are not restrictive of the invention, as claimed.

DESCRIPTION OF EMBODIMENTS

Hereinafter, a paper conveying apparatus, jam detection method, and computer program according to an embodiment, will be described with reference to the drawings. However, note that the technical scope of the invention is not limited to these embodiments and extends to the inventions described in the claims and their equivalents.

Figure 1:
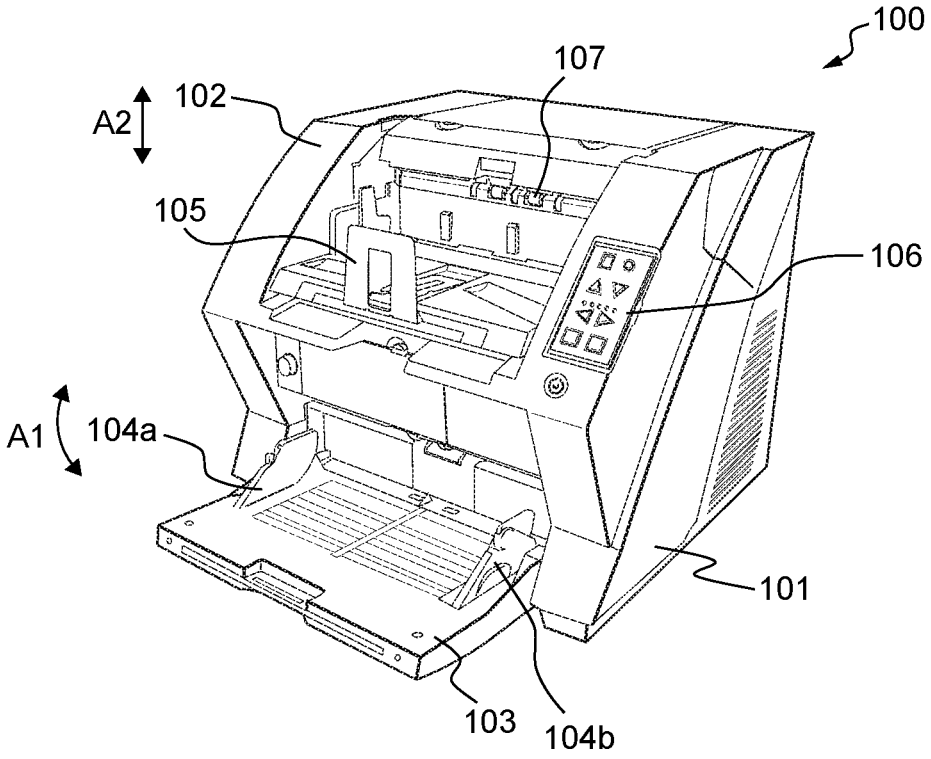
FIG. 1 is a perspective view of a paper conveying apparatus 100 according to an embodiment.

FIG. 1 is an exemplary embodiment of a perspective view which shows a paper conveying apparatus 100 which is configured as an image scanner, according to an embodiment.

A paper conveying apparatus 100 is provided with a housing 101, a front cover 102, a hopper 103, a stacker 105, operation buttons 106, etc.

The front cover 102 is arranged at a position covering the front surface of the paper conveying apparatus 100 and is engaged with the housing 101 by a hinge so as to be able to be opened and closed at the time a paper jams, that is, when cleaning the inside of the paper conveying apparatus 100.

The hopper 103 is a paper tray which places sheets of paper. It is engaged with the housing 101 so as to be able to be pivoted in the direction shown by the arrow A1. The hopper 103 is provided with side guides 104*a* and 104*b* able to move in a direction perpendicular to the paper conveyance direction, that is, to the left-right direction with respect to the paper conveyance direction. By positioning the side guides 104*a* and 104*b* to match the width of a paper, it is possible to restrict the width direction of the paper.

The stacker 105 is an ejection tray which holds paper s ejected from an ejection slot 107 and engages with the front cover 102 to be able to move in an up-down direction (direction shown by arrow A2) corresponding to the height of the stacked papers.

The operation buttons 106 are arranged at the surface of the front cover 102. If pressed, they generate and output operation detection signals.

Figure 2:
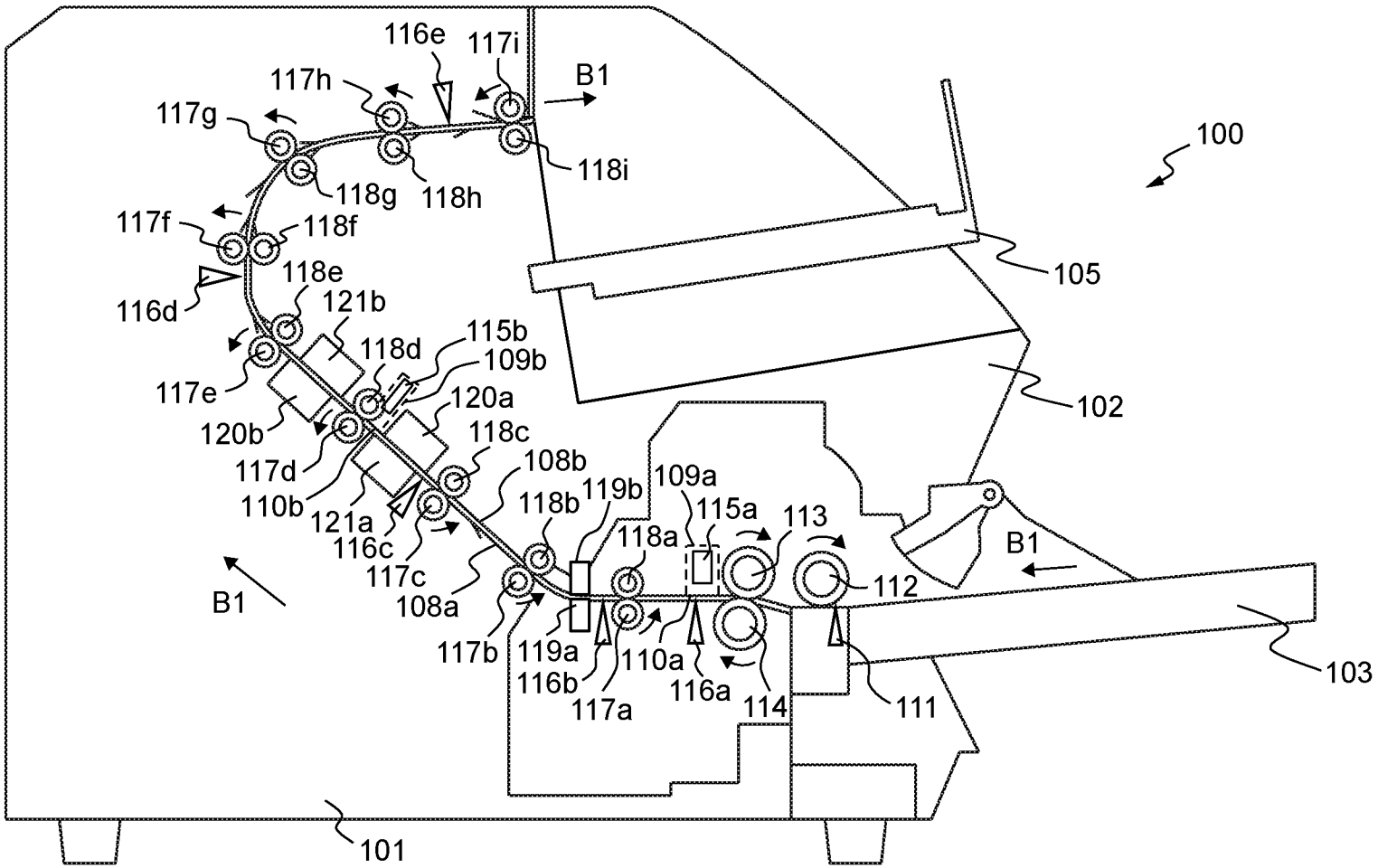
FIG. 2 is a view for explaining a conveyance path at the inside of a paper conveying apparatus 100.

FIG. 2 is a view for explaining a conveyance path at the inside of the paper conveying apparatus 100.

The conveyance path at the inside of the paper conveying apparatus 100 includes a hopper paper detector 111, pick roller 112, separator roller 113, brake roller 114, first microphone 115*a*, second microphone 115*b*, and first to fifth conveyed paper detectors 116*a* to 116*e*. The conveyance path further has first to ninth conveyor rollers 117*a* to 117*i*, first to ninth driven rollers 118*a* to 118*i*, ultrasonic transmitter 119*a*, ultrasonic receiver 119*b*, first image capture module 120*a*, second image capture module 120*b*, first backing switching module 121*a*, second backing switching module 122*b*, etc.

The surface of the housing 101 inside the apparatus forms a first guide 108*a* of the paper conveyance path, while the surface of the front cover 102 inside the apparatus facing the surface of the housing 101 forms a second guide 108*b* of the paper conveyance path. In FIG. 2, the arrow B1 shows the paper conveyance direction. Below, "upstream" means upstream in the paper conveyance direction B1, while "downstream" means downstream in the paper conveyance direction B1.

The hopper paper detector 111 has an optical sensor arranged at the upstream side of the separator roller 113 and brake roller 114 and detects whether the hopper 103 is placing a paper. The hopper paper detector 111 generates and outputs a hopper paper detection signal changing in signal value between the state where the hopper 103 places a paper and the state where it does not place a paper.

The first microphone 115*a* is one example of a sound detector. It is provided near the paper conveyance path, detects the sound generated by a paper during conveyance of the paper, and generates an analog signal corresponding to the detected sound. The first microphone 115*a* is arranged at the downstream side of the separator roller 113 and brake roller 114 and is fastened at an arm 109*a* of the inside of the front cover 102. To enable sound generated by a paper during conveyance to be more accurately detected by the first microphone 115*a*, a hole 110*a* is provided at a position of the second guide 108*b* facing the first microphone 115*a*.

The first conveyed paper detector 116*a* has an optical sensor at the downstream side of the separator roller 113 and brake roller 114 and the upstream side of the first conveyor roller 117*a* and first driven roller 118*a*. The first conveyed paper detector 116*a* detects whether there is a paper at that position. The first conveyed paper detector 116*a* generates and outputs a first paper detection signal with a signal value changing between a state where there is a paper present at that position and a state where there is not a paper present at that position.

The second conveyed paper detector 116*b* has an optical sensor arranged at the downstream side of the first conveyor roller 117*a* and the first driven roller 118*a* and the upstream side of the ultrasonic transmitter 119*a* and the ultrasonic receiver 119*b*. The second conveyed paper detector 116*b* detects whether there is a paper at that position. The second conveyed paper detector 116*b* generates and outputs a second paper detection signal changing in signal value between a state where there is a paper at that position and a state where there is not a paper at that position.

The ultrasonic transmitter 119*a* and the ultrasonic receiver 119*b* are an example of an ultrasonic detector, and are arranged near the conveyance path of the paper so as to face each other across the conveyance path. The ultrasonic transmitter 119*a* transmits an ultrasonic wave. On the other hand, the ultrasonic receiver 119*b* detects an ultrasonic wave which is transmitted by the ultrasonic transmitter 119*a* and passes through the paper or papers, and generates and outputs an ultrasonic signal comprised of an electrical signal corresponding to the detected ultrasonic wave. Below, the ultrasonic transmitter 119*a* and the ultrasonic receiver 119*b* will sometimes be referred to altogether as the "ultrasonic sensor 119".

The third conveyed paper detector 116*c* has an optical sensor arranged at the downstream side of the third conveyor roller 117*c* and the third driven roller 118*c* and the upstream side of the first image capture module 120*a* and first backing switching module 121*a*. The third conveyed paper detector 116*c* detects whether there is a paper at that position. The third conveyed paper detector 116*c* generates and outputs a third paper detection signal changing in signal value between a state where there is a paper at that position and a state where there is not a paper at that position.

The second microphone 115*b* is an example of a sound detector. It is provided in the vicinity of the paper conveyance path, detects the sound generated by a paper during conveyance of the paper, and generates an analog signal corresponding to the detected sound. The second microphone 115*b* is fastened at the downstream side of first image capture module 120*a* and first backing switching module 121*a* and the upstream side of the second image capture module 120*b* and the second backing switching module 121*b* fastened to the frame 109*b* of the inside of the front cover 102. To enable a sound generated by a paper during conveyance to be more accurately detected by the second microphone 115*b*, a hole 110*b* is provided at a position of the second guide 108*b* facing the second microphone 115*b*.

The fourth conveyed paper detector 116*d* has an optical sensor arranged at the downstream side of the fifth conveyor roller 117*e* and the fifth driven roller 118*e* and the upstream side of the sixth conveyor roller 117*f* and sixth driven roller 118*f*. The fourth conveyed paper detector 116*d* detects whether there is a paper at that position. The fourth conveyed paper detector 116*d* generates and outputs a fourth paper detection signal changing in signal value between a state where there is a paper at that position and a state where there is not a paper at that position.

The fifth conveyed paper detector 116*e* has an optical sensor arranged at the downstream side of the eighth conveyor roller 117*h* and the eighth driven roller 118*h* and the upstream side of the ninth conveyor roller 117*i* and ninth driven roller 118*i*. The fifth conveyed paper detector 116*e* detects whether there is a paper at that position. The fifth conveyed paper detector 116*e* generates and outputs a fifth paper detection signal changing in signal value between a state where there is a paper at that position and a state where there is not a paper at that position.

Below, sometimes the first to fifth conveyed paper detectors 116*a* to 116*e* will be referred to all together as the "conveyed paper detectors 116". Note that, the hopper paper detector 111 and conveyed paper detectors 116 may have contact detection sensors instead of optical sensors and detect whether there are papers at their positions.

A paper placed on the hopper 103 is conveyed toward the paper conveyance direction B1 by the pick roller 112 rotating in the arrow direction in FIG. 2 and is fed between the separator roller 113 and the brake roller 114. The separator roller 113 rotates in the arrow direction in FIG. 2 when conveying a paper. On the other hand, the brake roller 114 is given a torque in a direction opposite to the direction of rotation of the separator roller 113 (arrow direction in FIG. 2). Due to the actions of the separator roller 113 and brake roller 114, when the hopper 103 places sheets of paper, only the paper contacting the separator roller 113 among the sheets of paper placed on the hopper 103 is separated. Therefore, it operates so that papers other than the separated paper are kept from being conveyed (prevention of multi-feed). The separator roller 113 and brake roller 114 function as paper separating modules.

The paper is guided by the first guide 108*a* and the second guide 108*b* while being conveyed toward the paper conveyance direction B1 by the first to ninth conveyor rollers 117*a* to 117*i* rotating in the arrow direction of FIG. 2. The conveyed paper is read by the first image capture module 120*a* and the second image capture module 120*b* and ejected onto the stacker 105.

Figure 3:
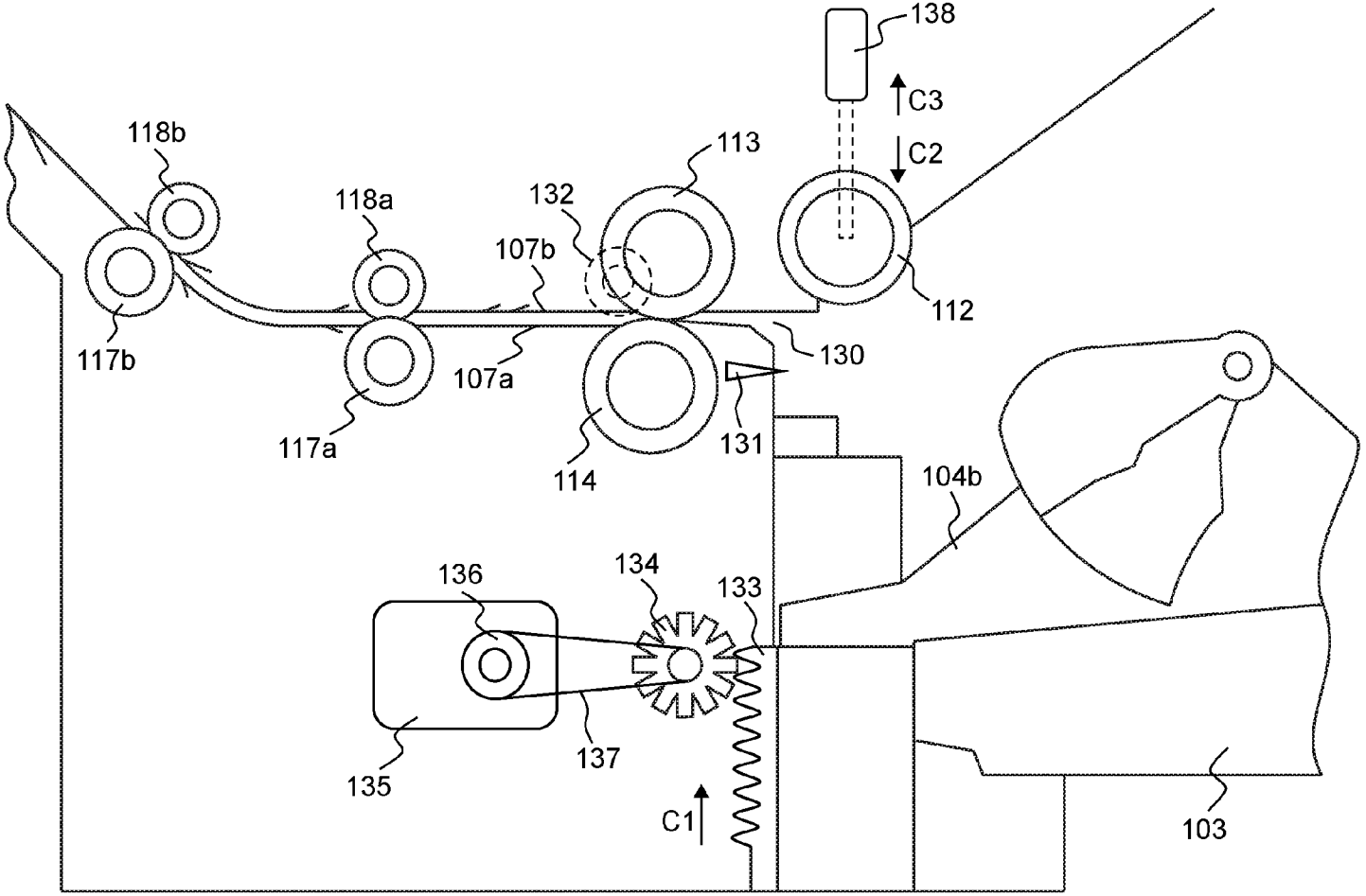
FIG. 3 is a view enlarging a vicinity of an entry slot of a conveyance path at the inside of a paper conveying apparatus 100.

FIG. 3 is a view enlarging the vicinity of an entry slot 130 of the inside of the paper conveying apparatus 100 shown in FIG. 2.

As shown in FIG. 3, the conveyance path at the inside of the paper conveying apparatus 100 further has a hopper paper surface detector 131 and encoder 132 etc.

The hopper paper surface detector 131 has a contact detection sensor arranged near the entry slot 130 and detects whether a paper placed on the hopper 103 is arranged at a position able to be conveyed. The hopper paper surface detector 131 generates and outputs a hopper paper surface detection signal changing in signal value between a state where a paper arranged on the hopper 103 is arranged at a position able to be conveyed and a state where it is not arranged at a position able to be conveyed.

The encoder 132 is arranged in the vicinity of a nip position of the separator roller 113 and the brake roller 114 and detects by its rotation whether a paper has been conveyed at that position (has moved). The encoder 132 generates and outputs a paper conveyance detection signal changing in signal value between a state where a paper is being conveyed and a state where it is not being conveyed.

As shown in FIG. 3, the hopper 103 has a hopper rack 133, while the paper conveying apparatus 100 further has a hopper gear 134 and a hopper motor 135. The hopper rack 133 engages with the hopper gear 134. A belt 137 is strung between the hopper gear 134 and the pulley 136 attached to the hopper motor 135.

By the hopper motor 135 driving the hopper gear 134 and the hopper rack 133 through the pulley 136 and belt 137, the hopper 103 moves in the direction of the arrow C1 and is arranged at a position able to convey a paper to the entry slot 130. The hopper rack 133 and the hopper gear 134 are movement members making the hopper 103 move and are examples of moving members driven in relation to conveyance of a paper.

As shown in FIG. 3, the paper conveying apparatus 100 further has a pick roller actuator 138 driving the pick roller 112. The pick roller 112 is acted on by a biasing force by a not shown spring in a direction toward the hopper 103 (direction of arrow C2). The pick roller actuator 138 runs a current to a solenoid to generate magnetic force and thereby moves the pick roller 112 in a direction moving away from the hopper 103 (direction of arrow C3). That is, the pick roller actuator 138 moves the pick roller 112 to either of a position contacting a paper placed on the hopper 103 or a position not contacting it. The pick roller 112 is an example of a moving member driven in relation to conveyance of a paper.

Figure 4A:
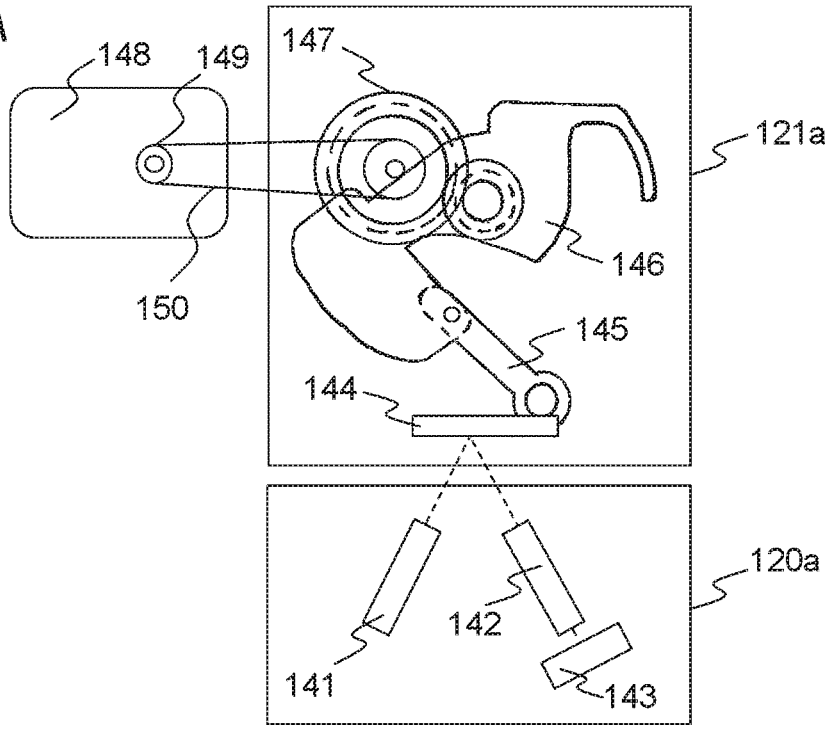
FIG. 4A is a view for explaining a first image capture module and first backing switching module.
Figure 4B:
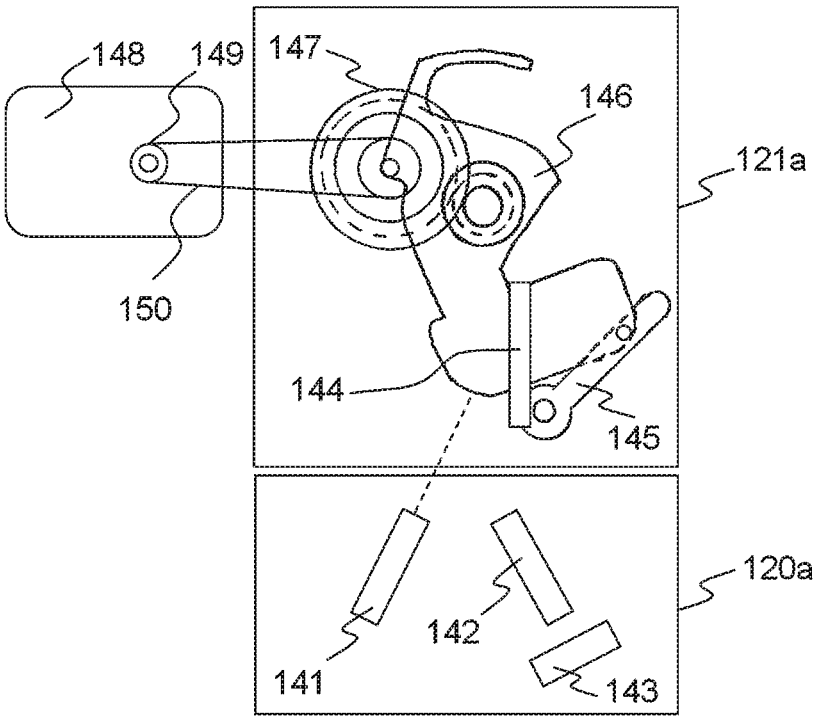
FIG. 4B is a view for explaining a first image capture module and first backing switching module.

FIG. 4A and FIG. 4B are views for explaining a first image capture module 120*a* and first backing switching module 121*a*.

The first image capture module 120*a* has a light source 141, lens 142, optical sensor 143, etc., and reads the front surface of the conveyed paper. The light source 141 is provided with RGB color LEDs (light emitting diodes) and a light guide member and emits light toward the conveyed paper. The lens 142 makes the light reflected at the paper strike the optical sensor 143. The lens 142 is, for example, comprised of a rod lens array. By passage of the light of the light source 141 reflected at the paper, a vertical image of the front surface of a paper is displayed by an equal magnitude on a not shown line sensor of the optical sensor 143. The optical sensor 143 is an equal magnification optical system type CIS (contact image sensor) provided with CMOS (complementary metal oxide semiconductor) image capture elements arranged in a line in the main scan direction. The optical sensor 143 generates an analog image signal corresponding to the light emitted from the light source 141, reflected at the front surface of the paper being conveyed, and passing through the lens 142.

The first backing switching module 121*a* is provided at a position facing the first image capture module 120*a* across the paper conveyance path. The first backing switching module 121*a* has a backing surface 144, arm 145, cam 146, backing gear 147, etc., while the paper conveying apparatus 100 further has a backing motor 148 for the first backing switching module 121. The backing surface 144 reflects the light emitted from the light source 141 of the first image capture module 120*a*. The backing surface 144 engages with the arm 145, the arm 145 engages with the cam 146, the cam 146 engages with the backing gear 147, and a belt 150 is strung between the backing gear 147 and the pulley 149 attached to the backing motor 148.

The backing motor 148 drives the backing surface 144 through the pulley 149, belt 150, backing gear 147, cam 146, and arm 145. Due to the backing motor 148, the position of the backing surface 144 is switched to either of a position facing the first image capture module 120*a* (FIG. 4A) or a position perpendicular to the first image capture module 120*a* (FIG. 4B). In the state of FIG. 4A, the surface of the backing surface 144 at the side facing the first image capture module 120*a* is white. The first image capture module 120*a* reads the backing surface 144 of the state of FIG. 4A when a paper is not being conveyed so as to obtain white reference data used for correction of the image such as shading. When a paper being conveyed is read in the state of FIG. 4A, the margin parts around the paper in the generated image signal become white, while when a paper being conveyed is read in the state of FIG. 4B, the margin parts around the paper in the generated image signal become black. At the time of conveyance of a paper, whether the backing surface 144 is rendered the state of FIG. 4A or rendered the state of FIG. 4B is set by the user using the operation buttons 106 in accordance with the color of the conveyed paper etc.

The second image capture module 120*b*, in the same way as the first image capture module 120*a*, has a light source, lens, optical sensor, etc., and reads the back surface of the conveyed paper. The light source is provided with RGB color LEDs and a light guide member and emits light to a conveyed paper. The lens makes the light reflected at a paper strike an optical sensor. Due to the lens, by passage of the light of the light source reflected at the paper, a vertical image of the surface of a paper is displayed by an equal magnitude on a line sensor of the optical sensor. The optical sensor 143 is an equal magnification optical system type CIS provided with CMOS (complementary metal oxide semiconductor) image capture elements arranged in a line in the main scan direction. The optical sensor generates and outputs an analog image signal corresponding to the light emitted from the light source, reflected at the back surface of the paper being conveyed, and passing through the lens.

The second backing switching module 121*b*, in the same way as the first backing switching module 121*a*, is provided at a position facing the second image capture module 120*b* across the paper conveyance path. The second backing switching module 121*b* has a backing surface, arm, cam, backing gear, etc., while the paper conveying apparatus 100 further has a backing motor for the second backing switching module 121*b*. The backing surface reflects the light emitted from the light source of the second image capture module 120*b*. The backing surface engages with the arm, the arm engages with the cam, the cam engages with the backing gear, and a belt is strung between the backing gear and a pulley attached to the backing motor.

The backing motor drives the backing surface through a pulley, belt, backing gear, cam, and arm. Due to the backing motor, the position of the backing surface is switched to either of a position facing the second image capture module 120*b* and a position perpendicular to the second image capture module 120*b*.

Note that, it is also possible to arrange just one of the first image capture module 120*a* and first backing switching module 121*a* or the second image capture module 120*b* and the second backing switching module 121*b* and read just one surface of a paper. Further, as the image capture sensor of the first image capture module 120*a* and the second image capture module 120*b*, instead of a CIS, it is also possible to use an image capture sensor of a reduction optical system type provided with an image capture device using a CCD (charge coupled device). Below, sometimes the first image capture module 120*a* and the second image capture module 120*b* will together be referred to as the "image capture modules 120" and the first backing switching module 121*a* and the second backing switching module 121*b* will together be referred to as the "backing switching modules 121". The backing switching modules 121 are examples of moving members driven in relation to paper conveyance.

Figure 5:
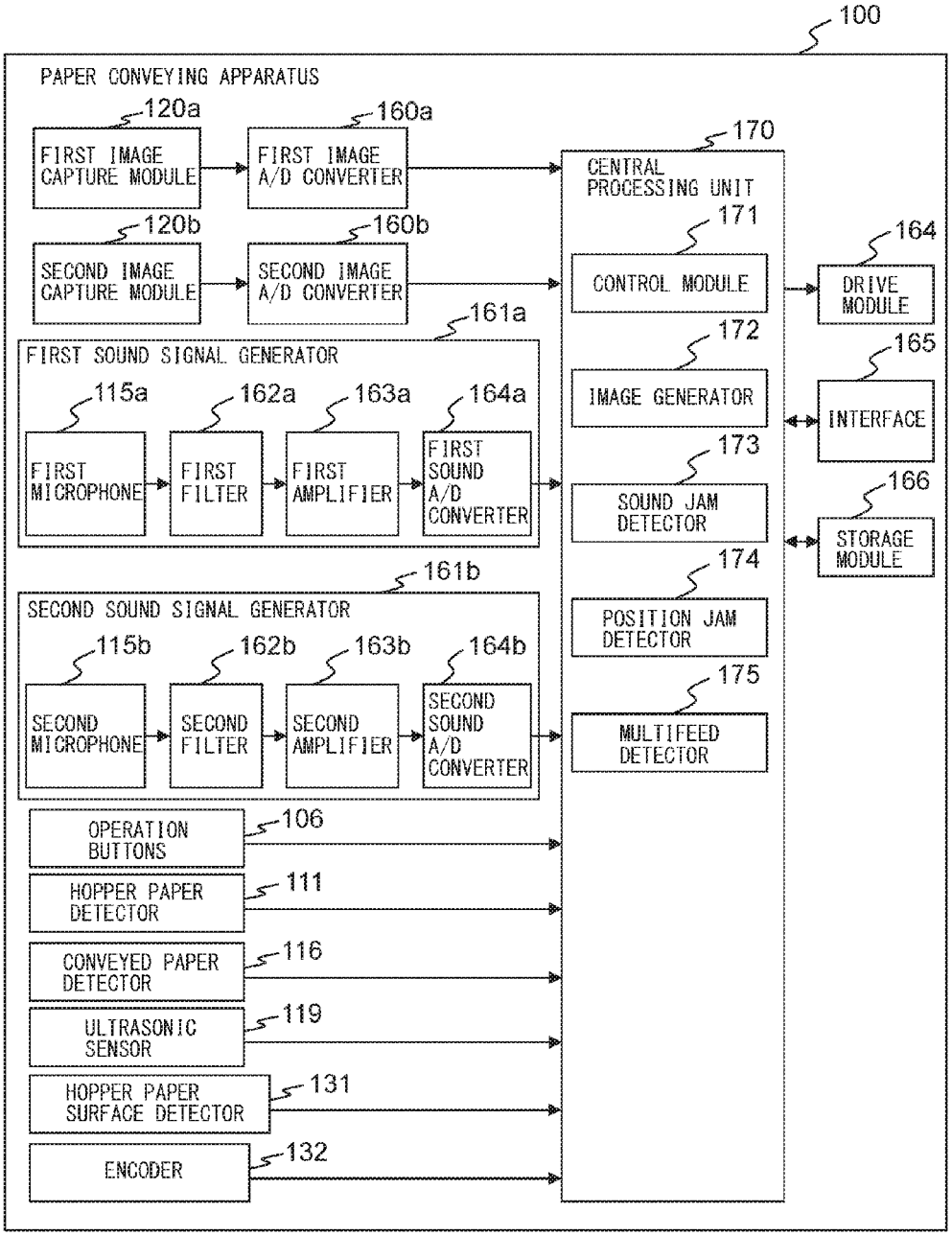
FIG. 5 is a block diagram showing the schematic configuration of a paper conveying apparatus 100.

FIG. 5 is a block diagram showing the schematic configuration of the paper conveying apparatus 100.

The paper conveying apparatus 100, in addition to the above-mentioned configuration, further has a first image A/D converter 160*a*, second image A/D converter 160*b*, first sound signal generator 161*a*, second sound signal generator 161*b*, drive module 165, interface 166, storage module 167, etc. The paper conveying apparatus 100 further has a central processing unit 170.

The first image A/D converter 160*a* converts the analog image signal output from the first image capture module 120*a* by A/D to generate digital image data and outputs it to the central processing unit 170. Similarly, the second image A/D converter 160*b* converts the analog image signal output from the second image capture module 120*b* by A/D to generate digital image data and outputs it to the central processing unit 170. Below, the digital image data will be referred to as the "read image". Further, below, the first image A/D converter 160*a* and the second image A/D converter 160*b* will together be referred to as the "image A/D converters 160".

The first sound signal generator 161*a* includes a first microphone 115*a*, first filter 162*a*, first amplifier 163*a*, first sound A/D converter 164*a*, etc. The first filter 162*a* applies a bandpass filter passing a signal of a predetermined frequency band to an analog signal output from the first microphone 115*a* and outputs it to the first amplifier 163*a*. The first amplifier 163*a* amplifies the signal output from the first filter 162*a* by a predetermined amplification rate and outputs it to the first sound A/D converter 164*a*. The first sound A/D converter 164*a* converts the analog signal output from the first amplifier 163*a* to a digital signal and outputs it to the central processing unit 170. Below, the signal which the first sound signal generator 161*a* generates and outputs will be referred to as the "first sound signal".

Note that, the first sound signal generator 161*a* is not limited to this. The first sound signal generator 161*a* may include only the first microphone 115*a*, and the first filter 162*a*, first amplifier 163*a*, and first sound A/D converter 164*a* may be provided outside of the first sound signal generator 161*a*. Further, the first sound signal generator 161*a* may include only the first microphone 115*a* and first filter 162*a* or may include only the first microphone 115*a*, first filter 162*a*, and first amplifier 163*a*.

The second sound signal generator 161*b* includes a second microphone 115*b*, second filter 162*b*, second amplifier 163*b*, second sound A/D converter 164*b*, etc. The second filter 162*b* applies a bandpass filter passing a signal of a predetermined frequency band to an analog signal output from the second microphone 115*b* and outputs it to the second amplifier 163*b*. The second amplifier 163*b* amplifies the signal output from the second filter 162*b* by a predetermined amplification rate and outputs it to the second sound A/D converter 164*b*. The second sound A/D converter 164*b* outputs an analog signal output from the second amplifier 163*b* to a digital second sound signal and outputs it to the central processing unit 170. Below, the signal which the second sound signal generator 161*b* generates and outputs will be referred to as the "second sound signal".

Note that, the second sound signal generator 161*b* is not limited to this. The second sound signal generator 161*b* may include only the second microphone 115*b*, and the second filter 162*b*, the second amplifier 163*b*, and the second sound A/D converter 164*b* may be provided outside of the second sound signal generator 161*b*. Further, the second sound signal generator 161*b* may include only the second microphone 115*b* and the second filter 162*b* or may include only the second microphone 115*b*, second filter 162*b*, and second amplifier 163*b*.

The drive module 165 includes the hopper motor 135, pick roller actuator 138, backing motor 148, and one or more motors making the pick roller 112, separator roller 113, and first to ninth conveyor rollers 117*a* to 117*i* rotate. The drive module 165 drives the hopper rack 133 and the hopper gear 134 to move the hopper 103 by a control signal from the central processing unit 170. Further, the drive module 165 drives the pick roller 112 by a control signal from the central processing unit 170. Further, the drive module 165 controls the backing switching module 121 by a control signal from the central processing unit 170. Further, the drive module 165 rotates the pick roller 112, separator roller 113, and first to ninth conveyor rollers 117*a* to 117*i* to perform the conveyance operation of a paper by a control signal from the central processing unit 170.

The interface 166 has, for example, a USB or other serial bus-based interface circuit and electrically connects with a not shown information processing apparatus (for example, personal computer, portable data terminal, etc.) to send and receive a read image and various types of information. Further, it is also possible to connect a flash memory etc., to the interface 166 so as to store the read image.

The storage module 167 has a RAM (random access memory), ROM (read only memory), or other memory device, a hard disk or other fixed disk device, or flexible disk, optical disk, or other portable storage device. Further, the storage module 167 stores a computer program, database, tables, etc., which are used in various processing of the paper conveying apparatus 100. The computer program may be installed on the storage module 167 from a computer-readable, non-transitory medium such as a compact disk read only memory (CD-ROM), a digital versatile disk read only memory (DVD-ROM), or the like by using a well-known setup program or the like. Furthermore, the storage module 147 stores the read image.

The central processing unit 170 is provided with a CPU (central processing unit) and operates based on a program which is stored in advance in the storage module 167. Note that, the central processing unit 170 may also be comprised of a DSP (digital signal processor), LSI (large scale integrated circuit), ASIC (application specific integrated circuit), FPGA (field-programming gate array), etc.

The central processing unit 170 is connected to operation buttons 106, the hopper paper detector 111, conveyed paper detector 116, ultrasonic sensor 119, hopper paper surface detector 131, and encoder 132 and controls these units. Further, the central processing unit 170 is connected to the first image capture module 120*a*, second image capture module 120*b*, first image A/D converter 160*a*, second image A/D converter 160*b*, and first sound signal generator 161*a* and second sound signal generator 161*b* and controls these units. Further, the central processing unit 170 is connected to a drive module 165, interface 166, and storage module 167 and controls these units.

The central processing unit 170 performs control for driving the drive module 165, control for reading a paper by the image capture modules 120, etc., to acquire a read image. Further, the central processing unit 170 has a control module 171, image generator 172, sound jam detector 173, position jam detector 174, multifeed detector 175, etc. These units are functional modules mounted by software operating on the processor. Note that, these units may be comprised of respectively independent integrated circuits, microprocessors, firmware, etc.

Figure 6:
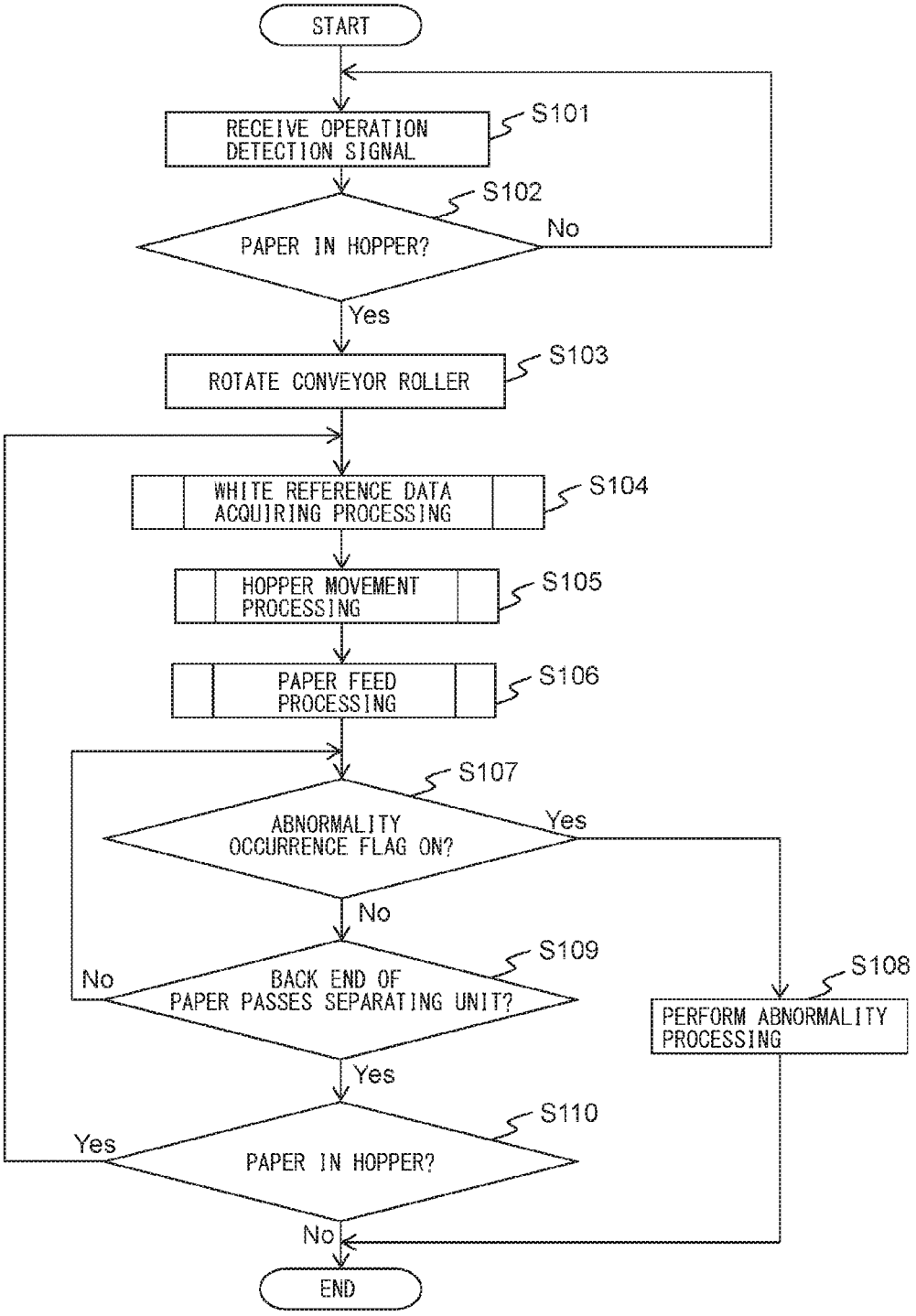
FIG. 6 is a flow chart showing an example of an operation of paper conveyance processing.

FIG. 6 is a flow chart showing an example of the operation of the paper conveyance processing of the paper conveying apparatus 100.

Below, an example of the operation of paper conveyance processing of the paper conveying apparatus 100 will be explained while referring to the flow chart shown in FIG. 6. Note that, the flow of the operation explained below is performed mainly by the central processing unit 170 in cooperation with the different components of the paper conveying apparatus 100 based on a program stored in advance in the storage module 167.

First, the control module 171 stands by until the user presses the operation buttons 106 and an operation detection signal is received from the operation buttons 106 (step S101).

Next, the control module 171 determines whether a paper is placed on the hopper 103 based on a hopper paper detection signal received from the hopper paper detector 111 (step S102).

When a paper is not placed on the hopper 103, the control module 171 returns the processing to step S101 and stands by until receiving a new operation detection signal from the operation buttons 106.

On the other hand, when a paper is placed on the hopper 103, the control module 171 drives the drive module 165 to rotate the first to ninth conveyor rollers 117*a* to 117*i* (step S103).

Next, the control module 171 performs white reference data acquisition processing (step S104). In white reference data acquisition processing, the control module 171 switches the position of the backing surface of the backing switching module 121 and acquires the white reference data used for correction of the image. Details of the white reference data acquisition processing will be explained later.

Next, the control module 171 performs hopper movement processing (step S105). In the hopper movement processing, the control module 171 moves the hopper 103 so that a paper placed on the hopper 103 can be conveyed to the entry slot 130. Details of the hopper movement processing will be explained later.

Next, the control module 171 performs paper feed processing (step S106). In the paper feed processing, the control module 171 moves the pick roller 112 to a position contacting a paper placed on the hopper 103 and conveys the paper. Details of the paper feed processing will be explained later.

Next, the control module 171 determines whether an abnormality occurrence flag is ON (step S107). This abnormality occurrence flag is set OFF when the paper conveying apparatus 100 is started up and is set ON when it is determined that an abnormality has occurred in a later explained abnormality determining processing.

When the abnormality occurrence flag is ON, as abnormality processing, the control module 171 stops the drive module 165 to stop the conveyance of the paper. Further, the control module 171 notifies the user of the occurrence of an abnormality by a not shown speaker, LED (light emitting diode), etc., and sets the abnormality occurrence flag OFF (step S108), then ends the series of steps.

On the other hand, when the abnormality occurrence flag is not ON, the control module 171 determines whether the back end of the paper has passed the separator roller 113 and brake roller 114 (step S109). The control module 171 determines that the back end of the paper has passed the separator roller 113 and brake roller 114 when the value of the first paper detection signal from the first paper detector 116*a* changes from a value showing the state where there is a paper to a value showing a state where there is not a paper.

When the back end of the paper has not passed the separator roller 113 and brake roller 114, the control module 171 returns the processing to step S107 and again determines whether the abnormality occurrence flag is ON.

On the other hand, when the back end of the paper passes the separator roller 113 and brake roller 114, the control module 171 determines whether a paper remains at the hopper 103 based on the hopper paper detection signal received from the hopper paper detector 111 (step S110).

When a paper remains in the hopper 103, the control module 171 returns the processing to step S104 and repeats the processing of steps S104 to S109. On the other hand, when a paper does not remain at the hopper 103, the control module 171 ends the series of steps. In this way, the control module 171 prevents a plurality of papers from being superposed in the conveyance path by preventing the next paper from being conveyed until the back end of the paper passes the separator roller 113 and brake roller 114.

Figure 7:
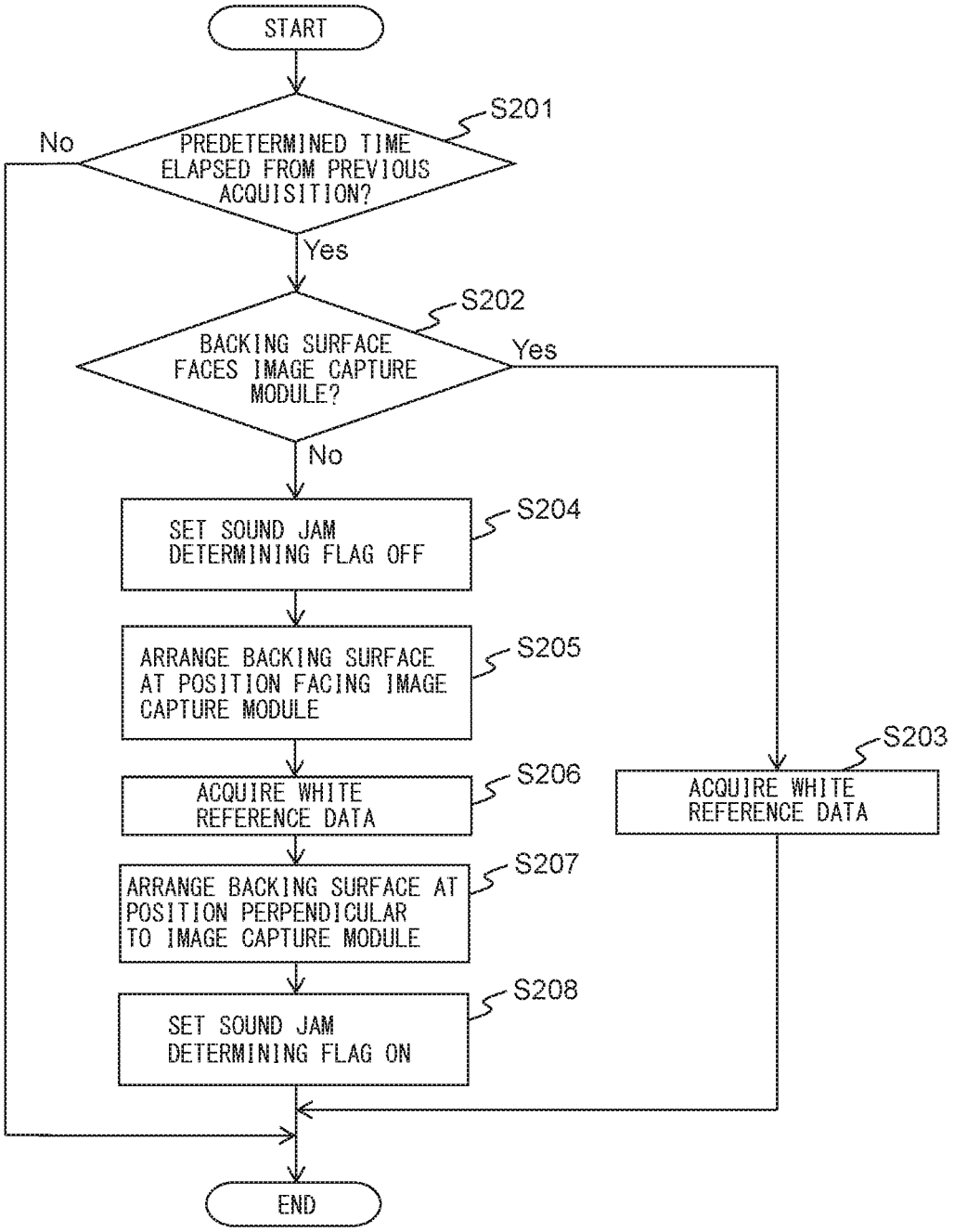
FIG. 7 is a flow chart showing an example of an operation of white reference data acquisition processing.

FIG. 7 is a flow chart showing an example of the operation of white reference data acquisition processing.

The flow of operation shown in FIG. 7 is executed at step S104 of the flow chart shown in FIG. 6.

First, the control module 171 determines whether a predetermined time (for example 90 seconds) has elapsed from when white reference data was obtained the previous time (step S201). Even if reading the same paper, due to the apparatus temperature etc., sometimes the values which the optical sensors of the image capture module 120 read will differ, so the control module 171 periodically acquires and updates the white reference data.

When a predetermined time has not elapsed from the previous time the white reference data was obtained, the control module 171 determines that it is not necessary to newly acquire white reference data and ends the series of steps. On the other hand, when a predetermined time has elapsed from the previous time the white reference data was obtained, the control module 171 determines that it is necessary to newly acquire white reference data. In this case, the control module 171 determines whether the backing surface (white surface) of the backing switching module 121 is arranged at a position facing the image capture module 120 (step S202).

When the backing surface is arranged at the position facing the image capture module 120, the control module 171 makes the image capture module 120 read the backing surface and acquires white reference data through the image A/D converter 160 (step S203). The control module 171 stores the acquired white reference data in the storage module 167 for use for correcting the read image (updates white reference data) and ends the series of steps.

On the other hand, when the backing surface is not arranged at the position facing the image capture module 120, the control module 171 sets the sound jam determining flag OFF (step S204).

Next, the control module 171 drives the backing motor 148 to switch the position of the backing surface to the position facing the image capture module 120 (step S205).

Next, the control module 171 makes the image capture module 120 read the backing surface and obtains white reference data through the image A/D converter 160 (step S206). The control module 171 stores the obtained white reference data in the storage module 167 for use for correcting the read image (updates the white reference data).

Next, the control module 171 drives the backing motor 148 to arrange the position of the backing surface at the position not facing the image capture module 120 (step S207).

Next, the control module 171 sets the sound jam determining flag ON (step S208) and ends the series of steps. Note that, when the sound jam determining flag is set OFF, at the later explained sound jam determining processing, the sound jam detector 173 does not determine whether a jam has occurred. Therefore, the control module 171 sets the sound jam determining flag OFF while the backing motor 148 is driving the backing switching module 121 whereby the control module 171 controls so that the sound jam detector 173 does not determine whether a jam has occurred.

Figure 8:
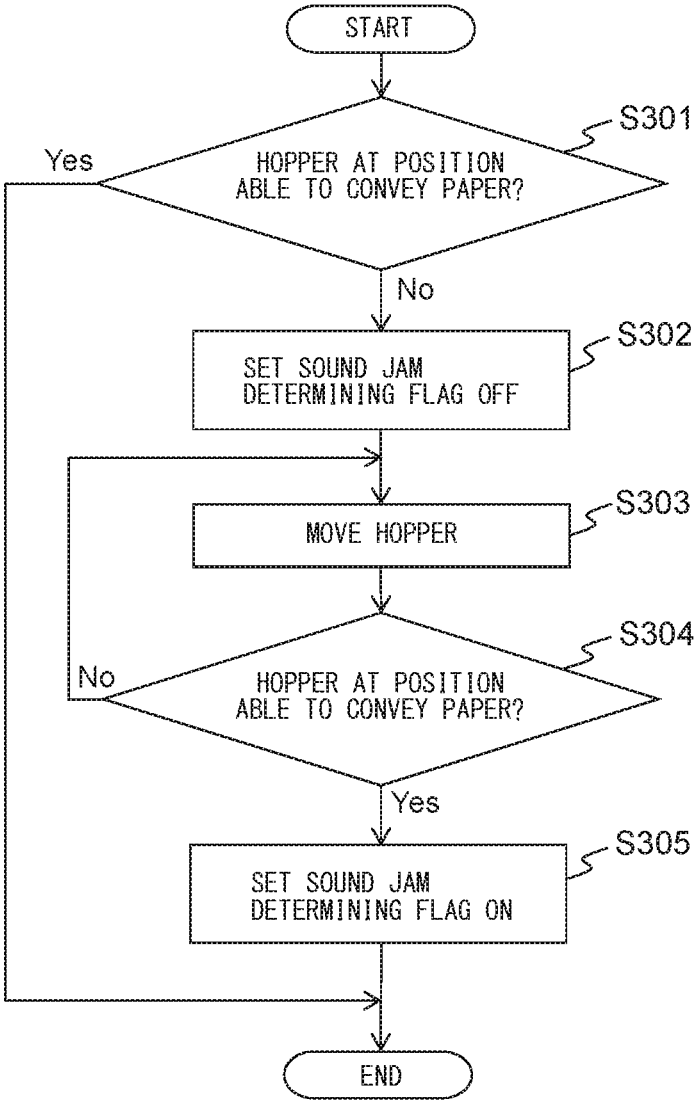
FIG. 8 is a flow chart showing an example of an operation of hopper movement processing.

FIG. 8 is a flow chart showing an example of the operation of hopper movement processing.

The flow of operation shown in FIG. 8 is performed at step S105 of the flow chart shown in FIG. 6.

First, the control module 171 determines whether the hopper 103 is arranged at a position able to convey a paper (step S301). The control module 171 determines whether the hopper 103 is arranged at a position where it can load a paper by whether the value of a hopper paper surface detection signal from the hopper paper surface detector 131 is a value showing the state where a paper placed on the hopper 103 is arranged at a position where it can be loaded.

When the hopper 103 is arranged at a position where it can load a paper, the control module 171 determines it is not necessary to move the hopper 103 and ends the series of steps. On the other hand, when the hopper 103 is not arranged at a position where it can load a paper, the control module 171 determines that the hopper 103 has to be moved and sets the sound jam determining flag OFF (step S302).

Next, the control module 171 drives the hopper motor 135 to move the hopper 103 (step S303).

Next, the control module 171 determines whether the hopper 103 has been arranged at a position where it can load a paper based on the hopper paper surface detection signal from the hopper paper surface detector 131 (step S304). The control module 171 repeats the processing of the steps S303 to S304 until the hopper 103 is arranged at a position where it can load a paper.

When the hopper 103 is arranged at a position where it can load a paper, the control module 171 sets the sound jam determining flag ON (step S305) and ends the series of steps. Due to this, the control module 171 controls so that the sound jam detector 173 does not determine whether a jam has occurred while the hopper motor 135 drives the hopper rack 133 and the hopper gear 134.

Figure 9:
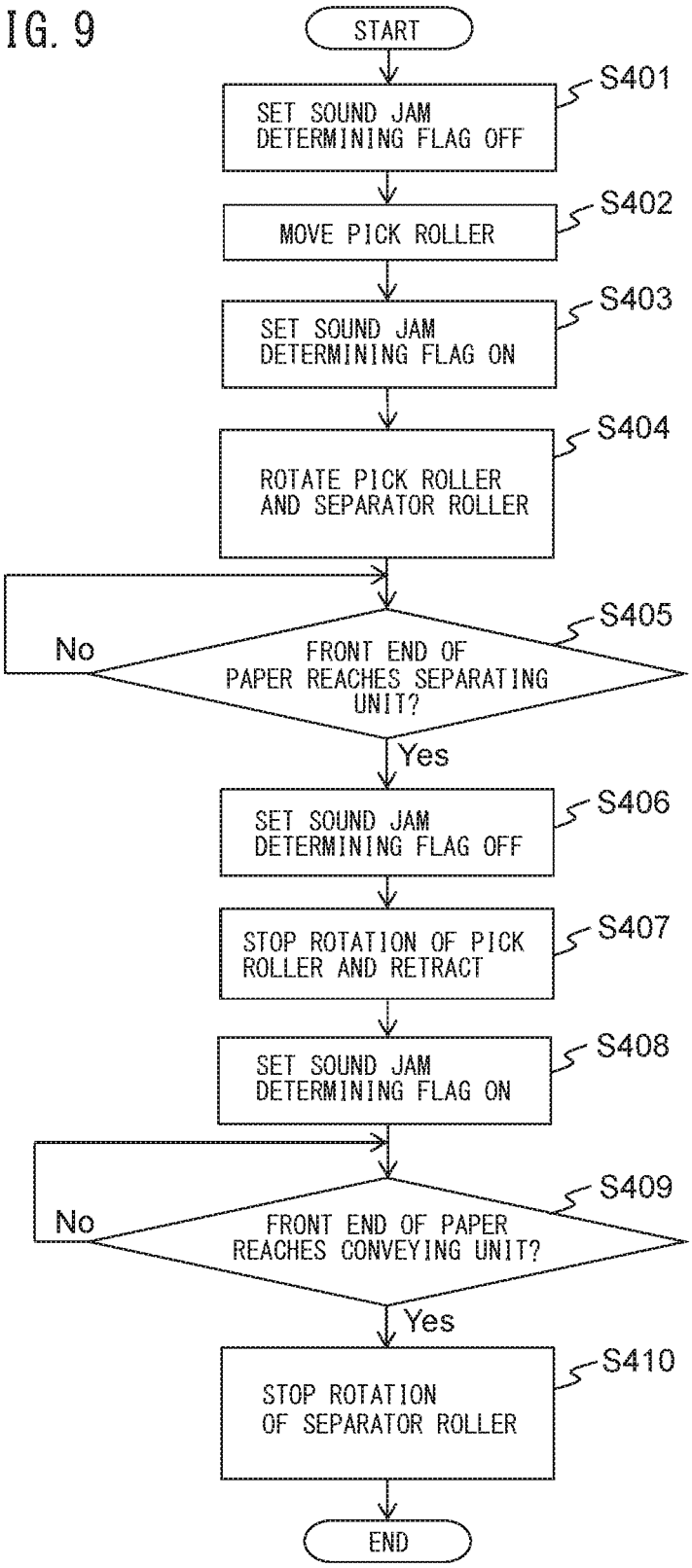
FIG. 9 is a flow chart showing an example of an operation of paper feed processing.

FIG. 9 is a flow chart showing an example of the operation of paper feed processing.

The flow of the operation shown in FIG. 9 is performed at step S106 of the flow chart shown in FIG. 6.

First, the control module 171 sets the sound jam determining flag OFF (step S401).

Next, the control module 171 controls the pick roller actuator 138 to move the pick roller 112 to a position contacting a paper placed on the hopper 103 (step S402).

Next, the control module 171 sets the sound jam determining flag ON (step S403).

Next, the control module 171 drives the drive module 165 to rotate the pick roller 112 and separator roller 113 (step S404).

Next, the control module 171 stands by until the front end of a paper reaches a nip position of the separator roller 113 and the brake roller 114 (step S405). The control module 171 determines that the front end of a paper has reached the separator roller 113 and the brake roller 114 when the value of the paper conveyance detection signal from the encoder 132 changes from a value showing the state where a paper is not being conveyed to a value showing the state where it is conveyed. Note that, the control module 171 may determine that the front end of a paper has reached the nip position of the separator roller 113 and brake roller 114 when a predetermined time elapses from when making the pick roller 112 and separator roller 113 rotate.

When the end of a paper reaches the nip position of the separator roller 113 and brake roller 114, the control module 171 sets the sound jam determining flag OFF (step S406).

Next, the control module 171 drives the drive module 165 to stop the rotation of the pick roller 112 and drives the pick roller actuator 138 to move the pick roller 112 to a position not contacting a paper placed on the hopper 103 (step S407).

Next, the control module 171 sets the sound jam determining flag ON (step S408). Due to this, the control module 171 controls so that the sound jam detector 173 does not determine whether a jam has occurred while the pick roller actuator 138 is driving the pick roller 112.

Next, the control module 171 stands by until the front end of a paper passes the first conveyor roller 117*a* and the first driven roller 118*a* (step S409). The control module 171 determines that the front end of a paper has passed the first conveyor roller 117*a* and the first driven roller 118*a* when the value of the second paper detection signal from the second paper detector 116*b* changes from a value showing the state where there is no paper present to a value showing the state where there is.

When the front end of a paper passes the first conveyor roller 117*a* and first driven roller 118*a*, the control module 171 controls the drive module 165 to stop the rotation of separator roller 113 (step S410) and ends the series of steps. After that, the paper is conveyed by the first to ninth conveyor rollers 117*a* to 117*i*.

Figure 10:
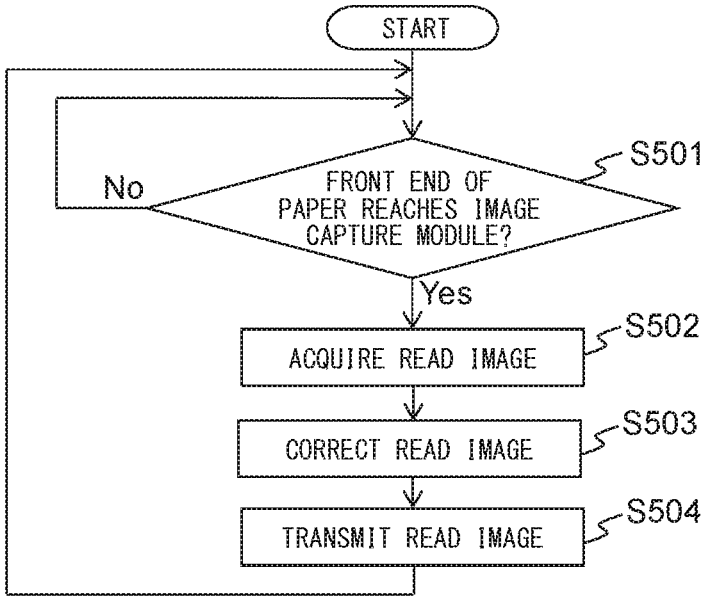
FIG. 10 is a flow chart showing an example of an operation of image reading processing.

Below, an example of the operation of the image reading processing of the paper conveying apparatus 100 will be explained while referring to the flow chart shown in FIG. 10. Note that, the flow of the operation explained below is performed mainly by the central processing unit 170 in cooperation with the different components of the paper conveying apparatus 100 based on a program stored in advance in the storage module 167.

First, the image generator 172 stands by until the front end of a paper reaches the position of the image capture module 120 (step S501). The image generator 172 determines that the front end of a paper has reached the position of the image capture module 120 when the value of a third paper detection signal from the third conveyed paper detector 116*c* changes from a value expressing the state where there is no paper present to a value expressing the state where there is.

When the front end of a paper reaches the position of the image capture module 120, the image generator 172 makes the image capture module 120 read the conveyed paper and acquires the read image through the image A/D converter 160 (step S502).

Next, the image generator 172 corrects the acquired read image using the white reference data stored in the storage module 167 (step S503).

Next, the central processing unit 170 sends the read image through the interface 166 to a not shown data processing system (step S504). Note that, when not connected to a data processing system, the central processing unit 170 stores the acquired read image in the storage module 167. After that, the central processing unit 170 returns the processing to step S501 and stands by until the front end of a newly conveyed paper reaches the position of the image capture module 120.

Figure 11:
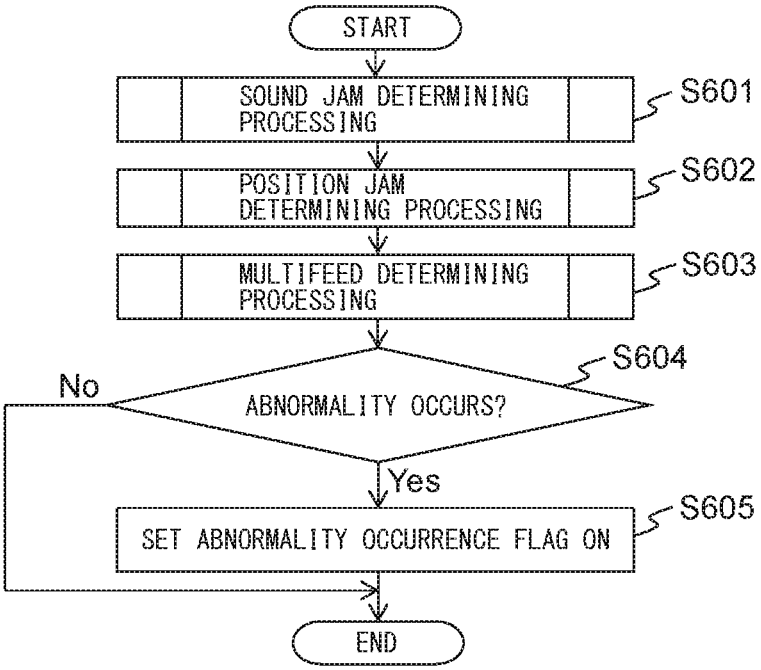
FIG. 11 is a flow chart showing an example of an operation of abnormality determining processing.

FIG. 11 is a flow chart which shows an example of an abnormality detection of the paper conveyance of the paper conveying apparatus 100.

The flow of operation which is explained below is executed based on a program which is stored in advance in the storage module 167 mainly by the central processing unit 150 in cooperation with the elements of the paper conveying apparatus 100.

First, the sound jam detector 173 executes sound jam detection processing (step S601). In the sound jam detection processing, the jam detector 173 determines whether a jam has occurred based on the first sound signal acquired from the first sound signal generator 161*a* and the second sound signal acquired from the second sound signal generator 161*b*. Below, sometimes a jam which is determined to exist by the sound jam detector 173 based on the first sound signal and the second sound signal will be referred to as a "sound jam". Details of the sound jam detection processing will be explained later.

Next, the position jam detector 174 performs position jam detection processing (step S602). In the position jam detection processing, the position jam detector 174 determines the occurrence of a jam based on the first paper detection signal to the fifth paper detection signal acquired from the first conveyed paper detector 116*a* to the fifth conveyed paper detector 116*e*. Below, sometimes a jam which is determined to exist by the position jam detector 174 based on the first paper detection signal to fifth paper detection signal will be referred to as a "position jam". Details of the position jam detection processing will be explained later.

Next, the multifeed detector 175 performs multifeed detection processing (step S603). In the multifeed detection processing, the multifeed detector 175 determines the occurrence of a multifeed of papers based on the ultrasonic signal which was acquired from the ultrasonic sensor 119. Details of the multifeed detection processing will be explained later.

Next, the control module 151 determines whether an abnormality has occurred in the paper conveyance processing (step S604). The control module 151 determines that an abnormality has occurred if at least one of a sound jam, position jam, and paper multifeed has occurred. That is, it is determined that no abnormality has occurred when none of a sound jam, position jam, or paper multifeed has occurred.

The control module 151 sets the abnormality flag to ON (step S605) and ends the series of steps when an abnormality occurs in the paper conveyance processing. On the other hand, when no abnormality occurs in the paper conveyance processing, it ends the series of steps without particularly performing any further processing. Note that, the flow chart which is shown in FIG. 11 is repeatedly executed every predetermined time interval.

Figure 12:
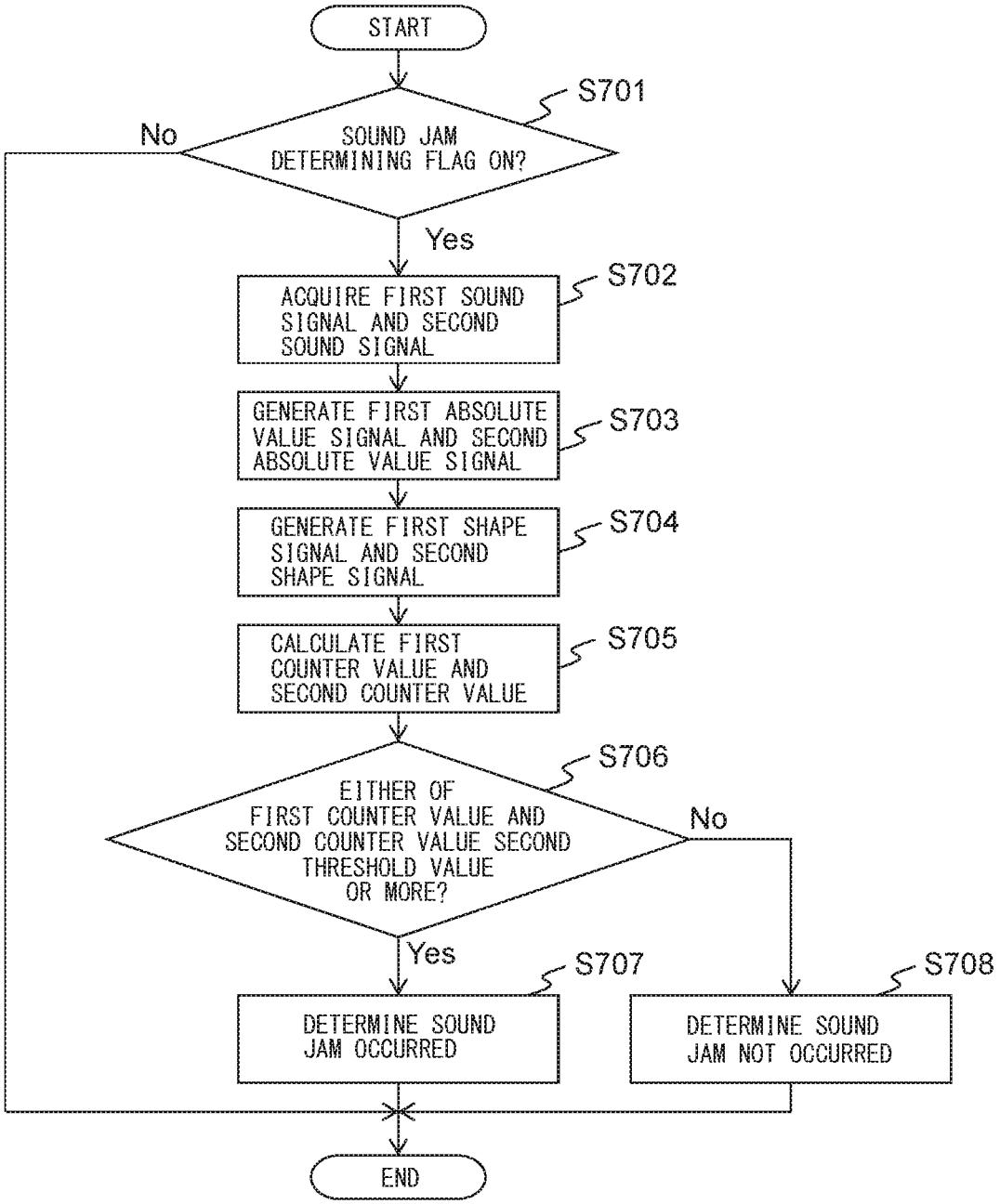
FIG. 12 is a flow chart showing an example of an operation of sound jam determining processing.

FIG. 12 is a flow chart showing an example of the operation of the sound jam determining processing.

The flow of operation shown in FIG. 12 is performed at step S601 of the flow chart shown in FIG. 11.

First, the sound jam detector 173 determines whether the sound jam determining flag is ON (step S701).

When the sound jam determining flag is OFF, the sound jam detector 173 does not perform the sound jam determining and ends the series of steps. On the other hand, when the sound jam determining flag is ON, the sound jam detector 173 acquires the first sound signal from the first sound signal generator 161*a* and acquires the second sound signal from the second sound signal generator 161*b* (step S702).

Figure 13A:
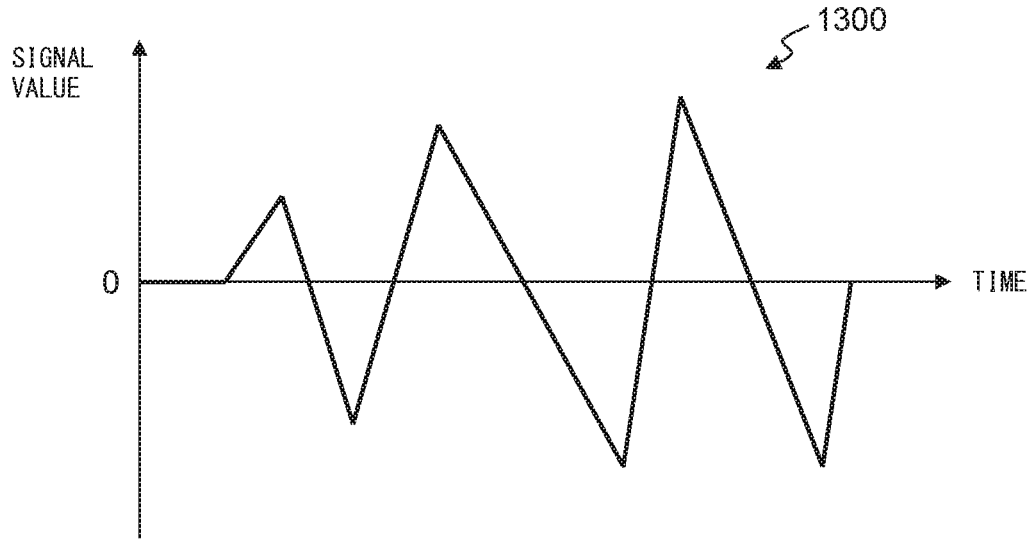
FIG. 13A is a view showing an example of a first sound signal.

FIG. 13A is a graph showing an example of the first sound signal. The graph 1300 shown in FIG. 13A shows a first sound signal acquired from the first sound signal generator 161*a*. The abscissa of the graph 1300 shows the time, while the ordinate shows the signal value.

Next, the sound jam detector 173 generates a first absolute value signal of the absolute value of the first sound signal and a second absolute value signal of the absolute value of the second sound signal (step S703).

Figure 13B:
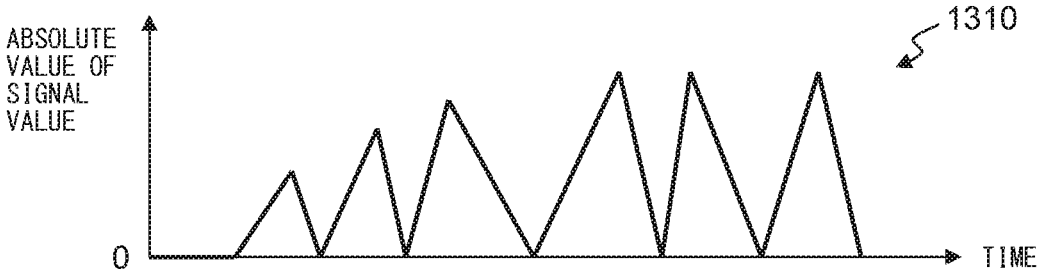
FIG. 13B is a view showing an example of a first absolute value signal.

FIG. 13B is a graph showing an example of the first absolute value signal. The graph 1310 shown in FIG. 13B shows the first absolute value signal of the absolute value of the first sound signal of the graph 1300. The abscissa of graph 1310 shows the time, while the ordinate shows the absolute value of the signal value.

Next, the sound jam detector 173 generates a first shape signal extracting the shape of the first absolute value signal and a second shape signal extracting the shape of the second absolute value signal (step S704). The sound jam detector 153 generates signals of the peak hold values of the first absolute value signal and the second absolute value signal as the first shape signal and the second shape signal. The sound jam detector 153 holds the local maximum values of the absolute value signals for exactly a certain hold period then causes them to attenuate by a certain attenuation rate to generate the shape signals.

Figure 13C:
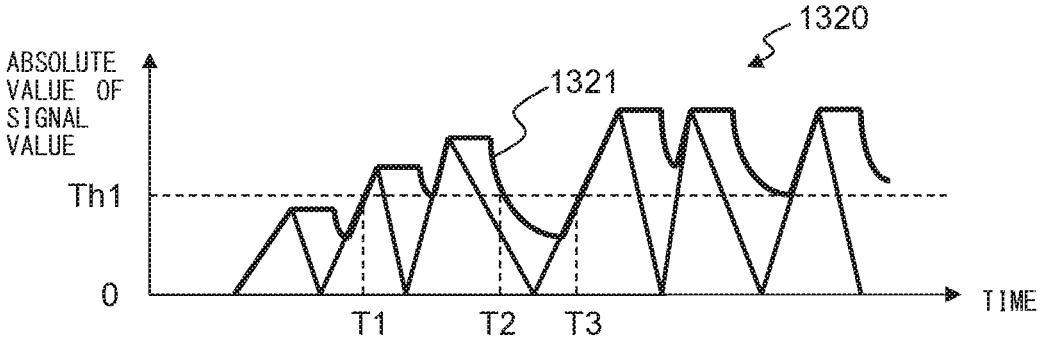
FIG. 13C is a view showing an example of a first shape signal.

FIG. 13C is a graph showing an example of the first shape signal. The graph 1320 shown in FIG. 13C shows the first shape signal 1321 extracting the shape of the first absolute value signal of the graph 1310. The abscissa of the graph 1320 shows the time, while the ordinate shows the absolute value of the signal value.

Next, the sound jam detector 173 calculates a first counter value which is made to increase when the signal value of the first shape signal is a first threshold value Th1 or more and is made to decrease when it is less than the first threshold value Th1. Similarly, the sound jam detector 173 calculates a second counter value making the signal value of the second shape signal increase when the first threshold value Th1 or more and making it decrease when less than the first threshold value Th1 (step S705).

That is, the first threshold value Th1 is a threshold value for comparing the values of the first sound signal and the second sound signal, while the sound jam detector 173 determines whether a jam has occurred based on the results of comparison of the values of the first sound signal and the second sound signal with the first threshold value Th1. Further, the first counter value and the second counter value are variables changing in accordance with the values of the first sound signal and the second sound signal. The sound jam detector 173 determines whether a jam has occurred based on the first counter value and the second counter value.

The sound jam detector 173 determines whether the signal value of the first shape signal is the first threshold value Th1 or more for each predetermined time interval (for example, sampling interval of sound signal). The sound jam detector 173 increments the first counter value when the signal value of the first shape signal is the first threshold value Th1 or more and decrements the first counter value when less than the first threshold value Th1. Similarly, the sound jam detector 173 determines whether the signal value of the second shape signal is the first threshold value Th1 or more at each predetermined time interval. The sound jam detector 173 increments the second counter value when the signal value of the second shape signal is the first threshold value Th1 or more and decrements the second counter value when it is less than the first threshold value Th1.

Figure 13D:
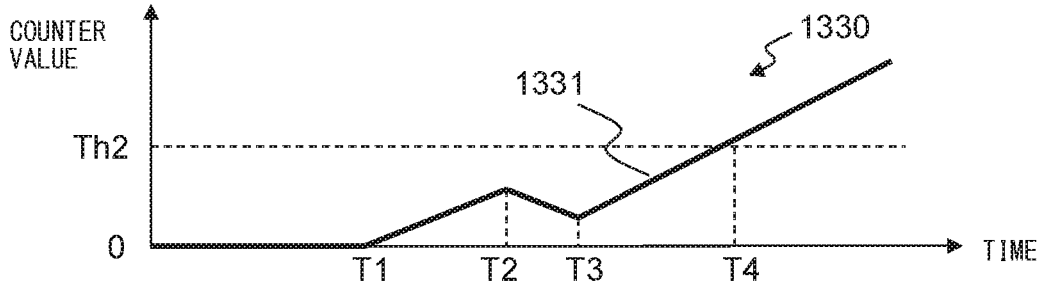
FIG. 13D is a view showing one example of a first counter value.

FIG. 13D is a graph showing an example of the first counter value. The graph 1330 shown in FIG. 13D shows the counter value 1331 calculated for the first shape signal 1321 of the graph 1320. The abscissa of the graph 1320 shows the time, while the ordinate shows the counter value.

Next, the sound jam detector 173 determines whether at least one of the first counter value and the second counter value is the second threshold value Th2 or more (step S706). The sound jam detector 173 determines that a sound jam has occurred when at least one of the first counter value and the second counter value is the second threshold value Th2 or more (step S707). On the other hand, the sound jam detector 173 determines that a sound jam has not occurred when both of the first counter value and the second counter value are less than the second threshold value Th2 (step S708), then ends the series of steps.

That is, the second threshold value Th2 is a threshold value for comparison with the number of the first sound signal and the second sound signal with values of the first threshold value Th1 or more. The sound jam detector 173 determines whether a jam has occurred based on the results of a comparison of the number that a value of the first sound signal and the second sound signal is the first threshold value Th1 or more with the second threshold value Th2.

In FIG. 13C, the first shape signal 1321 becomes the first threshold value Th1 or more at the time T1, becomes less than the first threshold value Th1 at the time T2, again becomes the first threshold value Th1 or more at the time T3, and, after that, does not become less than the first threshold value Th1. For this reason, as shown in FIG. 13D, the first counter value 1331 increases from the time T1, decreases from the time T2, again increases from the time T3, and becomes the second threshold value Th2 or more at the time T4, whereupon it is determined that a sound jam has occurred.

Note that, at step S704, the sound jam detector 173 may find signals extracting envelopes of the first absolute value signal and the second absolute value signal as the first shape signal and the second shape signal instead of finding signals of the peak hold values of the first absolute value signal and the second absolute value signal.

Figure 14A:
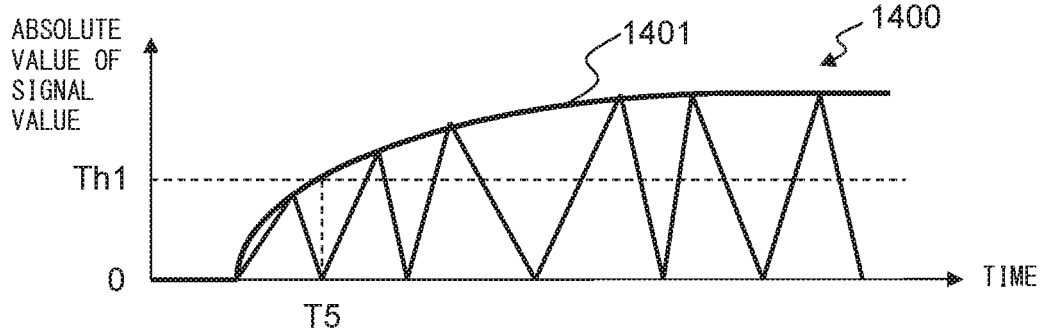
FIG. 14A is a view showing another example of a first shape signal.

FIG. 14A is a graph showing another example of the first shape signal. The graph 1400 shown in FIG. 14A shows the first shape signal 1401 extracting the envelope from the first absolute value signal of the graph 1310. The abscissa of the graph 1400 shows time, while the ordinate shows the absolute value of the signal value.

Figure 14B:
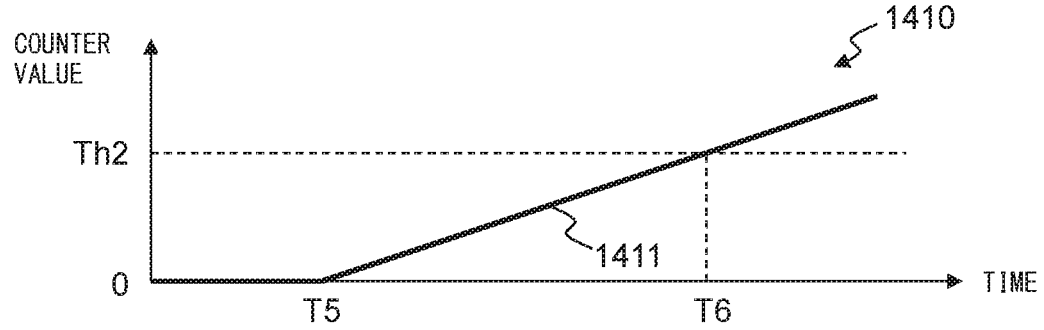
FIG. 14B is a view showing another example of a first counter value.

FIG. 14B is a graph showing another example of the first counter value. The graph 1410 shown in FIG. 14B shows the counter value 1411 calculated for the first shape signal 1401 of the graph 1400. The abscissa of the graph 1410 shows the time, while the ordinate shows the counter value. The first shape signal 1401 becomes the first threshold value Th1 or more at the time T5 and, after that, does not become less than the first threshold value Th1. For this reason, as shown in FIG. 14B, the counter value increases from the time T5 and becomes the second threshold value Th2 or more at the time T6. The sound jam detector 173 determines that a sound jam has occurred.

Below, the differences between when performing sound jam determining while the drive modules are driving the moving member and when not will be explained with reference to the backing motor 148 and backing switching module 121.

Figure 15A:
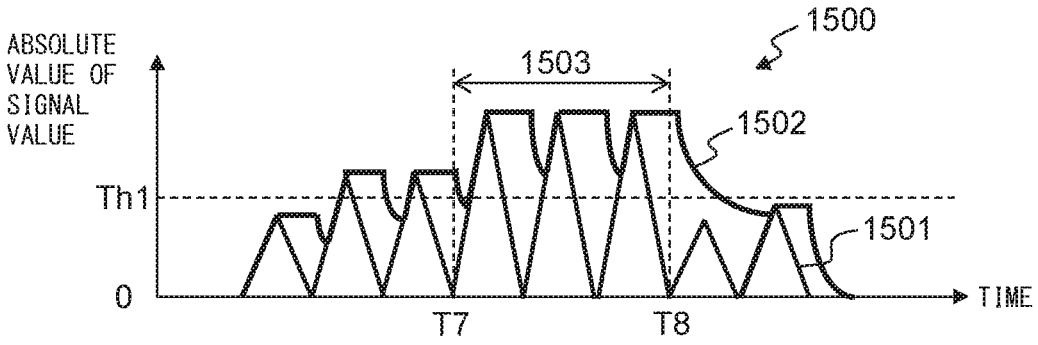
FIG. 15A is a view showing an example of a signal in the case of determining a jam while driving a moving member.
Figure 15B:
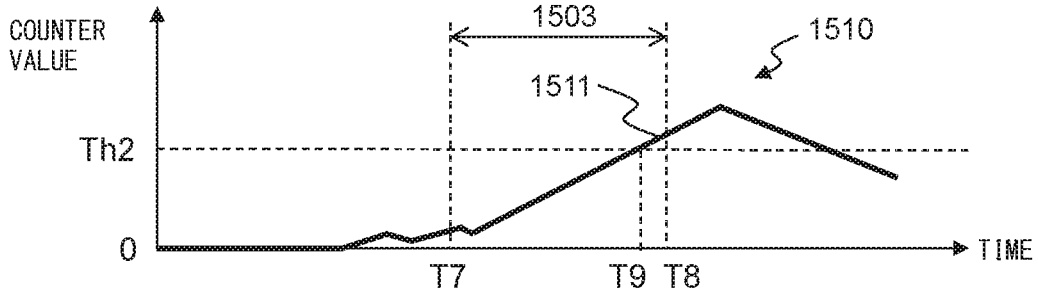
FIG. 15B is a view showing an example of a signal in the case of determining a jam while driving a moving member.

FIG. 15A and FIG. 15B are graphs showing examples of signals when performing sound jam determining while the backing motor 148 is driving the backing switching module 121.

The abscissas of FIG. 15A and FIG. 15B show the time, the ordinate of FIG. 15A shows the absolute value of the signal value, and the ordinate of FIG. 15B shows the counter value. The graph 1500 of FIG. 15A shows the first absolute value signal 1501 and the first shape signal 1502 when performing a sound jam determining while the backing motor 148 is driving the backing switching module 121. The section 1503 of the times T7 to T8 show sections where the backing motor 148 was driving the backing switching module 121. The graph 1510 of FIG. 15B shows an example of the first counter value 1511 calculated for the first shape signal 1502.

At the section 1503, due to the sound generated by the backing switching module 121, the first absolute value signal 1501 becomes larger and the signal value of the first shape signal 1502 becomes the first threshold value Th1 or more. Therefore, at the section 1503, the first counter value 1511 continues to increase. At the time T9, it becomes the second threshold value Th2 or more so it is determined that a sound jam has occurred.

Figure 16A:
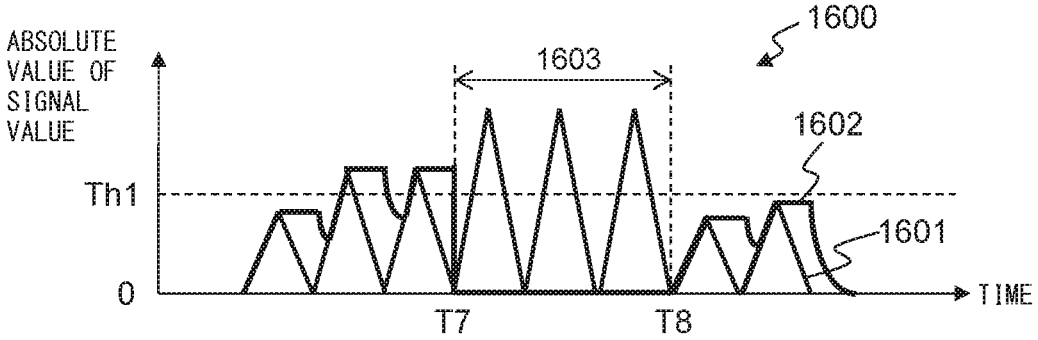
FIG. 16A is a view showing an example of a signal in the case of not determining a jam while driving a moving member.
Figure 16B:
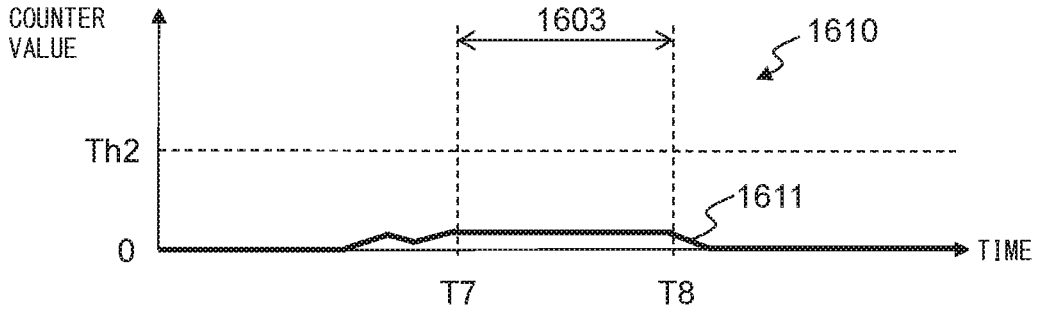
FIG. 16B is a view showing an example of a signal in the case of not determining a jam while driving a moving member.

FIG. 16A and FIG. 16B are graphs showing examples of signals when not determining a sound jam while the backing motor 148 is driving the backing switching module 121.

The abscissas of FIG. 16A and FIG. 16B show the time, the ordinate of FIG. 16A shows the absolute value of the signal value, and the ordinate of FIG. 16B shows the counter value. The graph 1600 of FIG. 16A shows the first absolute value signal 1601 and the first shape signal 1602 when sound jam determining was not performed while the backing motor 148 is driving the backing switching module 121. The section 1603 of the times T7 to T8 show the section where the backing motor 148 had been driving the backing switching module 121. The graph 1610 of FIG. 16B shows an example of the first counter value 1611 calculated for the first shape signal 1602.

At section 1603, the first absolute value signal 1601 becomes larger due to the sound generated by the backing switching module 121. However, the sound jam determining is not performed, so the first counter value 1611 remains held as the value at the time T7 and does not become the second threshold value Th2 or more, so it is determined that no sound jam has occurred. Therefore, it is possible to keep the sound generated by the backing switching module 121 from causing it to be mistakenly determined by the sound that a jam has occurred.

In this way, the control module 171 controls so that the sound jam detector 173 holds the first counter value and the second counter value while the drive module is driving the moving member. Note that, the control module 171 may control so that the sound jam detector 173 resets the first counter value and the second counter value while the drive module is driving the moving member. In this case, the sound jam detector 173 resets the first counter value and the second counter value at step S701 when the sound jam determining flag is OFF.

Figure 16C:
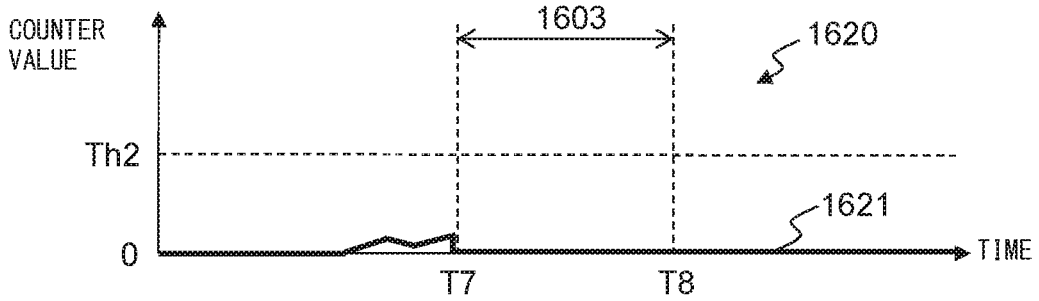
FIG. 16C is a view showing an example of a signal when resetting a first counter value.

FIG. 16C is a graph showing examples of signals when not performing sound jam determining and resetting the first counter value while the backing motor 148 is driving the backing switching module 121.

The abscissa of FIG. 16C shows the time, while the ordinate shows the counter value. The graph 1620 of FIG. 16C shows an example of the first counter value 1621 calculated for the first shape signal 1602 of FIG. 16A. The first counter value 1621 is reset at the time T7 at the head of the section 1603. It does not become the second threshold value Th2 or more, so it is determined that no sound jam has occurred.

By holding the counter values while the drive module is driving the moving member, when a jam occurs while driving the moving member, it is possible to detect a jam early after stopping the moving member. On the other hand, by resetting the counter values while the drive module is driving the moving member, it is possible to suppress the effects and keep a jam from being mistakenly detected when noise etc., is generated right before driving the moving member.

Note that, the control module 171 may control so that the sound jam detector 173 determines whether a jam has occurred by a determining method different from a determining method used while the drive module is not driving the moving member, while the drive module drives the moving member.

For example, the control module 171 changes the first threshold value Th1 between while the drive module is driving the moving member and while it is not driving the moving member. The control module 171 sets the first threshold value Th1 at a value larger than a value used when the drive module does not drive the moving member instead of setting the sound jam determining flag OFF at step S204 of FIG. 7, step S302 of FIG. 8, and steps S401 and S406 of FIG. 9. Further, the control module 171 sets the first threshold value Th1 at the original value instead of setting the sound jam determining flag ON at step S208 of FIG. 7, step S305 of FIG. 8, and steps S403 and S408 of FIG. 9.

Figure 17A:
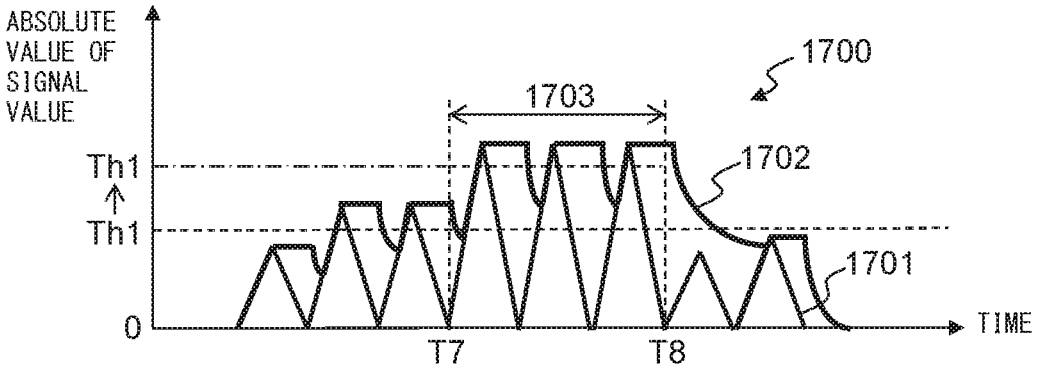
FIG. 17A is a view showing an example of a signal when changing a first threshold value Th1.
Figure 17B:
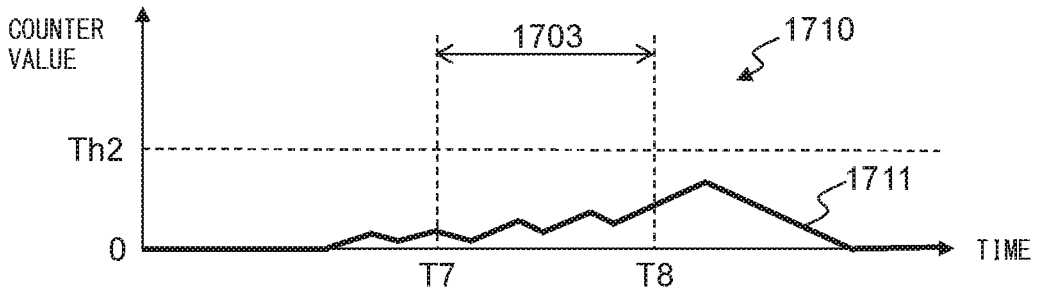
FIG. 17B is a view showing an example of a signal when changing a first threshold value Th1.

FIG. 17A and FIG. 17B are graphs showing examples of signals when setting the first threshold value Th1 to a large value while the backing motor 148 is driving the backing switching module 121 compared with a value used while not driving the backing switching module 121.

The abscissas of FIG. 17A and FIG. 17B show the time, the ordinate of FIG. 17A shows the absolute value of the signal value, and the ordinate of the FIG. 17B shows the counter value. The graph 1700 of FIG. 17A shows the first absolute value signal 1701 and first shape signal 1702. The section 1703 of the times T7 to T8 shows a section where the backing motor 148 drove the backing switching module 121. The graph 1710 of FIG. 17B shows an example of the first counter value 1711 calculated for the first shape signal 1702.

At the section 1703, due to the sound generated by the backing switching module 121, the first absolute value signal 1701 and the first shape signal 1702 become larger. However, the first threshold value Th1 also becomes larger, so the first counter 1711 repeatedly increases and decreases and does not become the second threshold value Th2 or more, so it is determined that no sound jam has occurred. Therefore, even while driving the backing switching module 121, it is possible to determine whether a jam has occurred by sound while it is possible to make it hard to determine that a jam has occurred and therefore it is possible to keep a jam from being mistakenly detected.

Further, the control module 171 may change the second threshold value Th2 between while the drive module is driving the moving member and while it is not driving the moving member. The control module 171 sets the second threshold value Th2 to a value larger than a value used when the drive module is not driving the moving member instead of setting the sound jam determining flag OFF at step S204 of FIG. 7, step S302 of FIG. 8, and steps S401 and S406 of FIG. 9. Further, the control module 171 sets the second threshold value Th2 at its original value instead of setting the sound jam determining flag ON at step S208 of FIG. 7, step S305 of FIG. 8, and steps S403 and S408 of FIG. 9. Note that, the second threshold value Th2 may be changed at each predetermined time interval for determining whether the signal values of the first shape signal and the second shape signal are the first threshold value Th1 or more. For example, the control module 171 adds a predetermined value (for example, 0.5) to the second threshold value Th2 at each predetermined time interval while the drive module is driving the moving member and, after stopping the drive operation of the moving member, subtracts a predetermined value from the second threshold value Th2 at each predetermined time interval until becoming the original value.

Figure 17C:
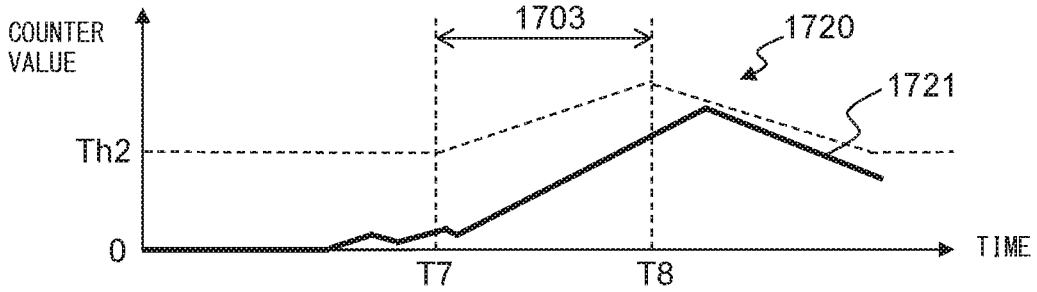
FIG. 17C is a view showing an example of a signal when changing a second threshold value Th2.

FIG. 17C is a graph showing an example of the counter value when setting the second threshold value Th2 at a larger value while the backing motor 148 is driving the backing switching module 121 compared with a value used while not driving the backing switching module 121.

The abscissa of FIG. 17C shows the time, while the ordinate shows the counter value. The graph 1720 of FIG. 17C shows an example of the first counter value 1721 calculated for the first shape signal 1702.

At the section 1703, due to the sound generated by the backing switching module 121, the first absolute value signal 1701, first shape signal 1702, and first counter value 1721 become larger. However, the second threshold value Th2 also becomes larger, so the first counter value 1721 does not become the second threshold value Th2 or more and it is determined that a sound jam has not occurred. Therefore, even while driving the backing switching module 121, it is possible to determine whether a jam has occurred by sound while it is possible to make it hard to determine that a jam has occurred and therefore it is possible to keep a jam from being mistakenly detected.

Further, the control module 171 may change the ratio of amplification or attenuation of the first sound signal and the second sound signal between while the drive module is driving the moving member and while it is not driving the moving member. The control module 171 changes the amplification rate by which the first amplifier 163*a* and the second amplifier 163*b* amplifies the signal instead of setting the sound jam determining flag OFF at step S204 of FIG. 7, step S302 of FIG. 8, and steps S401 and S406 of FIG. 9. The control module 171 sets the amplification rate when the drive module is driving the moving member to a value smaller than a value used when the drive module is not driving the moving member (for example, 0.5 time). Further, the control module 171 sets the amplification rate at the original value instead of setting the sound jam determining flag ON at step S208 of FIG. 7, step S305 of FIG. 8, and steps S403 and S408 of FIG. 9. Note that, the control module 171 stops the supply of power to the first microphone 115*a* and the second microphone 115*b* and cuts the output of the first sound signal and the second sound signal while the drive module is driving the moving member. Further, the control module 171 may reduce or render zero the value of the digital first sound signal and second sound signal output from the first sound A/D converter 164*a* and the second sound A/D converter 164*b* while the drive module is driving a moving member.

Figure 18A:
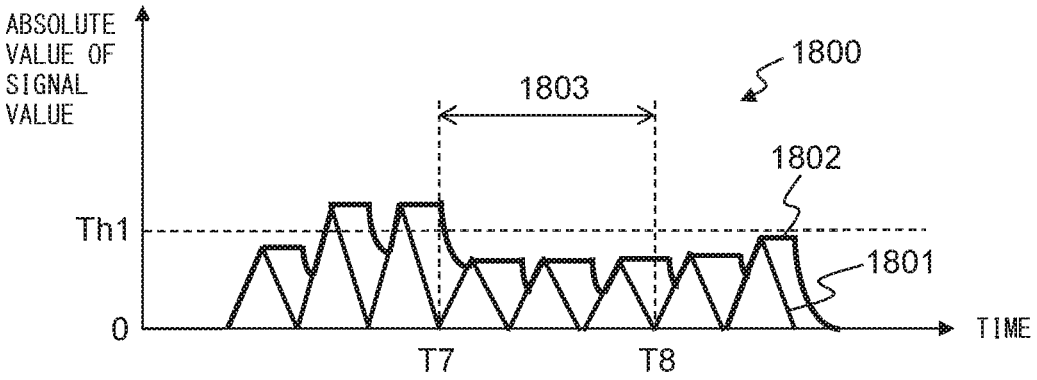
FIG. 18A is a view showing an example of a signal when changing an amplification rate.
Figure 18B:
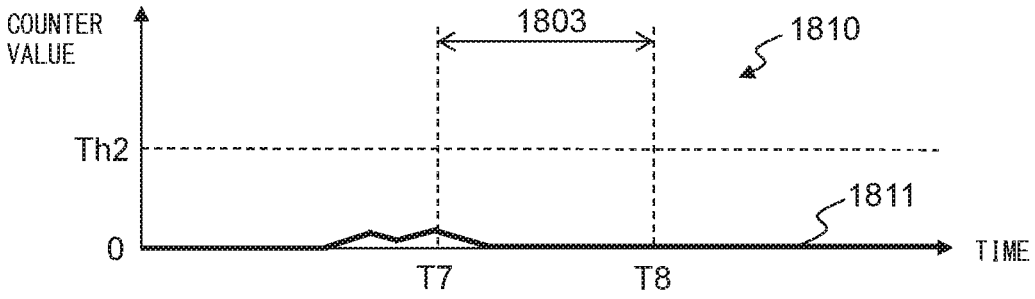
FIG. 18B is a view showing an example of a signal when changing an amplification rate.

FIG. 18A and FIG. 18B are graphs showing examples of signals when setting the amplification rates by the first amplifier 163*a* and the second amplifier 163*b* to smaller values while the backing motor 148 drives the backing switching module 121 compared with a value used while not driving the backing switching module 121.

The abscissas of FIG. 18A and FIG. 18B show the time, the ordinate of FIG. 18A shows the absolute value of the signal value, and the ordinate of FIG. 18B shows the counter value. The graph 1800 of FIG. 18A shows the first absolute value signal 1801 and the first shape signal 1802. The section 1803 of the times T7 to T8 indicates the section where the backing motor 148 had been driving the backing switching module 121. The graph 1810 of FIG. 18B shows an example of the first counter value 1811 calculated for the first shape signal 1802.

At section 1803, a large sound is generated by the backing switching module 121, but the amplification rate by the first amplifier 163*a* is made small, so the first absolute value signal 1801 and the first shape signal 1802 do not become large. For this reason, the first counter 1811 does not become the second threshold value Th2 or more and it is determined that no sound jam has occurred. Therefore, it is possible to determine whether a jam has occurred by sound while making it harder for it to be determined that a jam has occurred and possible to keep a jam from being mistakenly detected even while driving the backing switching module 121.

Figure 19:
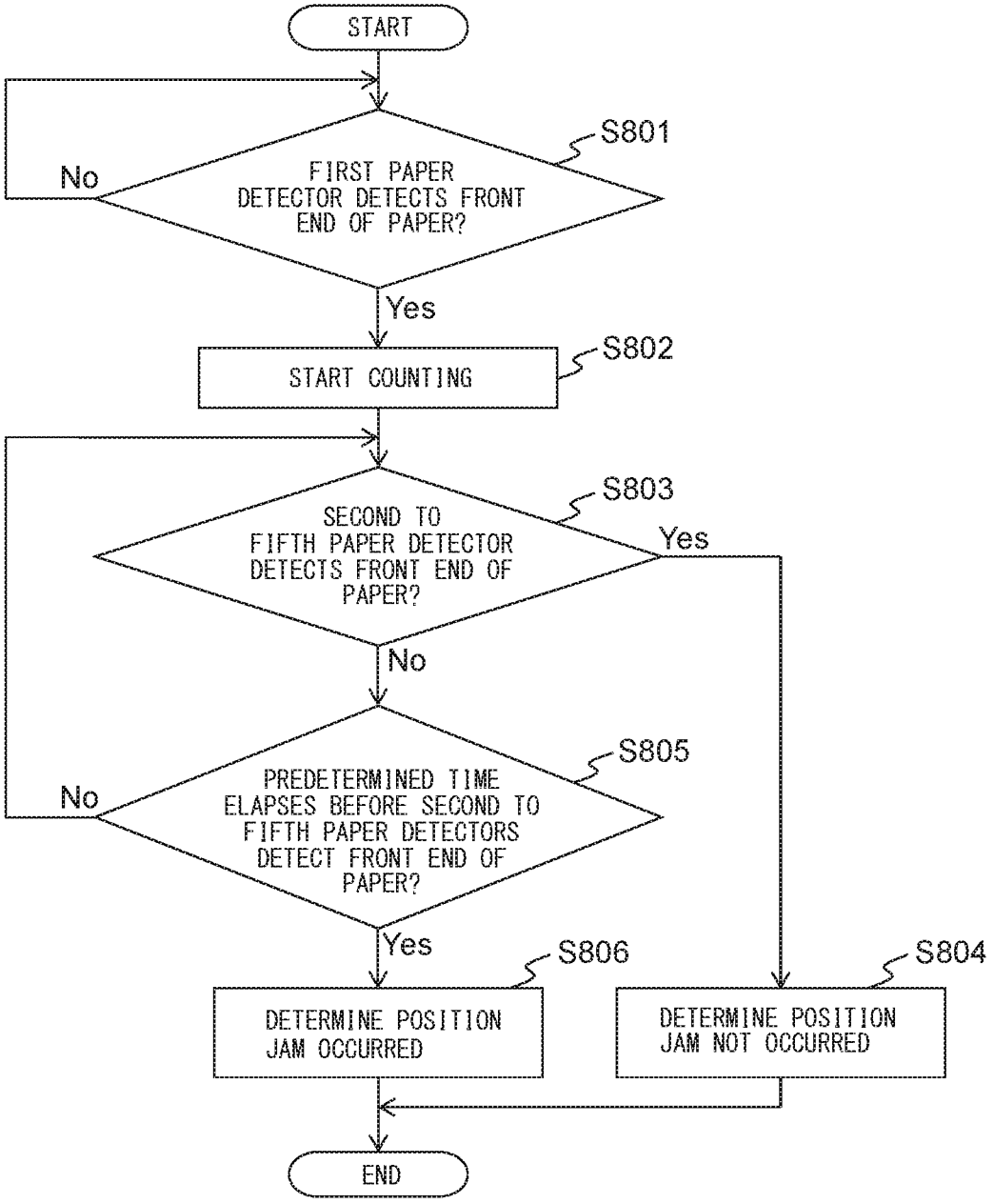
FIG. 19 is a flow chart showing an example of an operation of position jam determining processing.

FIG. 19 is a flow chart showing an example of the operation of position jam determining processing.

The flow of the operation shown in FIG. 19 is performed at step S602 of the flow chart shown in FIG. 11.

First, the position jam detector 174 stands by until the first paper detector 116*a* detects the front end of a paper (step S801). The position jam detector 174 determines that the front end of a paper has been detected at the position of the first paper detector 116*a* when the value of the first paper detection signal from the first paper detector 116*a* changes from a value expressing a state where there is no paper to a value expressing a state where there is.

Next, when the first paper detector 116*a* detects the front end of a paper, the position jam detector 174 starts the count (step S802).

Next, the position jam detector 174 determines whether the second to fifth conveyed paper detectors 116*b* to 116*e* have detected the front ends of papers (step S803). The position jam detector 174 determines that the front end of a paper has been detected at the position of the each conveyed paper detector 116 when the value of each paper detection signal from each paper detector changes from a value expressing a state where there is no paper to a value expressing a state where there is.

When all of the second to fifth conveyed paper detectors 116*b* to 116*e* detect the front ends of papers, the position jam detector 174 determines that a position jam has not occurred (step S804), then the series of steps is ended.

On the other hand, when none of the second to fifth conveyed paper detectors 116*b* to 116*e* detects the front end of a paper, the position jam detector 174 determines whether a predetermined time set for the conveyed paper detector has elapsed from the start of the count (step S805). When the second to fifth conveyed paper detectors 116*b* to 116*e* detect the front ends of the papers or when a predetermined time set in the paper detector has not elapsed, the position jam detector 174 returns the processing to step S803. On the other hand, when a predetermined time set for the conveyed paper detectors elapses before the front end of a paper is detected at any of the second to fifth conveyed paper detectors 116*b* to 116*e*, the position jam detector 174 determines that a position jam has occurred (step S806). Further, the position jam detector 174 ends the series of steps. Note that, when position jam determining processing is not required at the paper conveying apparatus 100, it may be omitted.

Note that, the position jam detector 174 may start the count at the time when controlling the drive module 165 so that the control module 171 rotates the separator roller 113. In this case as well, the position jam detector 174 determines that a position jam has occurred when each conveyed paper detector does not detect the front end of a paper within a predetermined time.

Figure 20:
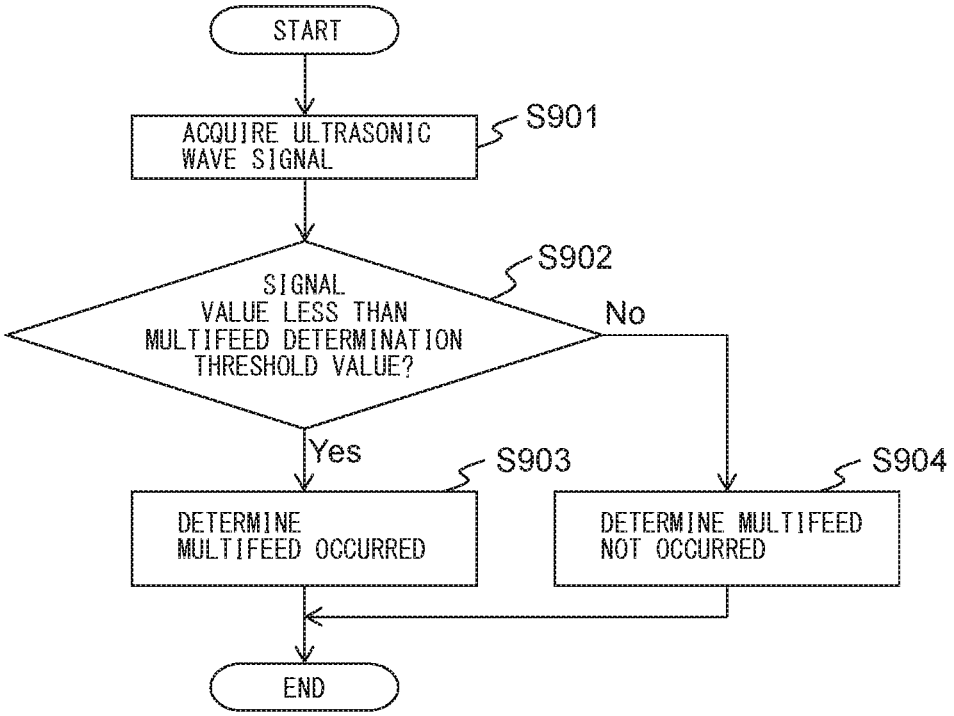
FIG. 20 is a flow chart showing an example of an operation of multifeed determining processing.

FIG. 20 is a flow chart which shows an example of operation of multifeed detection processing.

The flow of operation which is shown in FIG. 11 is executed at step S603 of the flow chart which is shown in FIG. 6.

First, the multifeed detector 175 acquires an ultrasonic signal from the ultrasonic sensor 119 (step S901).

Next, the multifeed detector 175 determines whether the signal value of the acquired ultrasonic signal is less than the multifeed detection threshold value (step S902).

Figure 21:
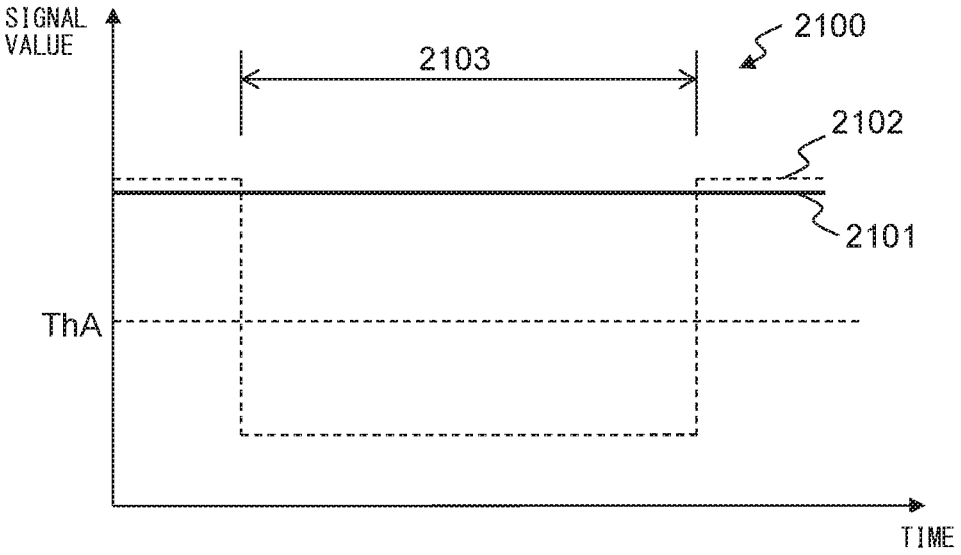
FIG. 21 is a view for explaining the characteristics of an ultrasonic wave signal.

FIG. 21 is a view for explaining properties of an ultrasonic signal.

In the graph 2100 of FIG. 21, the solid line 1601 shows the characteristic of the ultrasonic signal in the case where a single paper is conveyed, while the broken line 2102 shows the characteristic of the ultrasonic signal in the case where multifeed of papers has occurred. The abscissa of the graph 2100 shows the time, while the ordinate shows the signal value of the ultrasonic signal. Due to the occurrence of multifeed, the signal value of the ultrasonic signal of the broken line 2102 falls in the section 2103. For this reason, it is possible to determine whether multifeed of papers has occurred by whether the signal value of the ultrasonic signal is less than the multifeed detection threshold value ThA.

The multifeed detector 175 determines that multifeed of the papers has occurred when the signal value of the ultrasonic signal is less than the multifeed detection threshold value (step S903). The multifeed detector 175 determines that multifeed of the papers has not occurred when the signal value of the ultrasonic signal is the multifeed detection threshold value or more (step S504), and ends the series of steps. Note that, when multifeed detection processing is not necessary in the paper conveying apparatus, this may be omitted.

As explained above, the paper conveying apparatus 100 is designed to operate in accordance with the flow charts shown in FIG. 6 to FIG. 9 and FIG. 12 so as to be able to control to not determine whether a jam has occurred while driving the moving member. Further, the paper conveying apparatus 100 is designed so as to be able to control so as to determine whether a jam has occurred while driving the moving member by a determining method different from a determining method used while not driving the moving member. Therefore, it becomes possible to keep the sound generated by a moving member driven in relation to conveyance of a paper from causing mistaken determining of occurrence of a jam by sound.

Above, preferable embodiments of the present invention were explained, but the present invention is not limited to these embodiments. For example, it is also possible to omit either of the first sound signal generator 161*a* or the second sound signal generator 161*b* and have the sound jam detector 173 determine whether a jam has occurred based on either of the first sound signal or the second sound signal. Further, the control module 171 may control so that sound jam determining is not performed or so as to change the method of determining of a jam only while at least one of the hopper rack 133 and the hopper gear 134, pick roller 112, and backing switching module 121 is being driven. While driving other moving members, control is performed so that sound jam determining is performed in the same way as when not driving them.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiment(s) of the present inventions have been described in detail, it should be understood that the various changes, substitutions, and alterations could be made hereto without departing from the spirit and scope of the invention.

REFERENCE SIGNS LIST

100. paper conveying apparatus
103. hopper
112. pick roller
120. image capture module
121. backing switching module
133. hopper rack
134. hopper gear
135. hopper motor
138. pick roller actuator
148. backing motor
161. sound signal generator
171. control module
173. sound jam detector

What is claimed is:

1. A paper conveying apparatus comprising:
a moving member driven in relation to conveyance of a paper;
a drive module for driving the moving member;
a sound signal generator for generating a sound signal corresponding to a sound generated by a paper during conveyance of the paper;
a sound jam detector for determining whether a jam has occurred based on the sound signal, and
a control module for stopping conveyance of a paper when the sound jam detector determines that a jam has occurred, wherein
the control module controls so that the sound jam detector determines whether a jam has occurred by a determining method different from a determining method used while the drive module is not driving the moving member, or the sound jam detector does not determine whether a jam has occurred, while the drive module is driving the moving member.

2. The paper conveying apparatus according to claim 1, further comprising a hopper which places a paper, wherein
the moving member is a pick roller conveying a paper placed on the hopper.

3. The paper conveying apparatus according to claim 1, further comprising:
a light source; and
an image capture module for generating an image signal corresponding to the light emitted from the light source, and reflected by a paper being conveyed; and wherein
the moving member is a switching module for, provided at a position facing the image capture module across a paper being conveyed, switching a position of a surface reflecting light emitted from the light source.

4. The paper conveying apparatus according to claim 1, further comprising a hopper which places a paper, and wherein
the moving member is a moving member for moving the hopper.

5. The paper conveying apparatus according claim 1, wherein
the sound jam detector determines whether a jam has occurred based on a variable updated according to a value of the sound signal, and
the control module controls so that the sound jam detector does not determine whether a jam has occurred and holds the variable, while the drive module is driving the moving member.

6. The paper conveying apparatus according to claim 1, wherein
the sound jam detector determines whether a jam has occurred based on a variable updated according to a value of the sound signal, and
the control module controls so that the sound jam detector does not determine whether a jam has occurred and resets the variable, while the drive module is driving the moving member.

7. The paper conveying apparatus according to claim 1, wherein the control module changes a ratio of amplifying or attenuating the sound signal between while the drive module is driving the moving member and while the drive module is not driving the moving member.

8. The paper conveying apparatus according to claim 1, wherein
the sound jam detector determines whether a jam has occurred based on results of comparison of a value of the sound signal and a first threshold value, and
the control module changes the first threshold value between while the drive module is driving the moving member and while the drive module is not driving the moving member.

9. The paper conveying apparatus according to claim 1, wherein
the sound jam detector determines whether a jam has occurred based on results of comparison of the number that a value of the sound signal is a first threshold value or more with a second threshold value, and
the control module changes the second threshold value between while the drive module is driving the moving member and while the drive module is not driving the moving member.

10. A method for determining a jam comprising;
driving a moving member driven in relation to conveyance of a paper;
acquiring a sound signal corresponding to a sound which a paper generates during conveyance;
determining, by a computer, whether a jam has occurred based on the sound signal; and stopping conveyance of a paper when determining that a jam has occurred, wherein the computer controls so that the sound jam detector determines whether a jam has occurred by a determining method different from a determining method used while the drive module is not driving the moving member, or the sound jam detector does not determine whether a jam has occurred, while the drive module is driving the moving member, in the determining step.

11. A computer-readable, non-transitory medium storing a computer program, wherein the computer program causes a computer to execute a process, the process comprising:

driving a moving member driven in relation to conveyance of a paper;

acquiring a sound signal corresponding to a sound which a paper generates during conveyance;

determining whether a jam has occurred based on the sound signal; and stopping conveyance of a paper when determining that a jam has occurred, wherein the computer controls so that the sound jam detector determines whether a jam has occurred by a determining method different from a determining method used while the drive module is not driving the moving member, or the sound jam detector does not determine whether a jam has occurred, while the drive module is driving the moving member, in the determining step.

* * * * *